US012104591B2

(12) United States Patent
Baird

(10) Patent No.: US 12,104,591 B2
(45) Date of Patent: Oct. 1, 2024

(54) FLUID PUMP ASSEMBLY

(71) Applicant: Jeffery D. Baird, Ada, OK (US)

(72) Inventor: Jeffery D. Baird, Ada, OK (US)

( * ) Notice: Subject to any disclaimer, the term of this patent is extended or adjusted under 35 U.S.C. 154(b) by 343 days.

(21) Appl. No.: 17/152,366

(22) Filed: Jan. 19, 2021

(65) Prior Publication Data

US 2021/0222691 A1 Jul. 22, 2021

Related U.S. Application Data

(60) Provisional application No. 62/961,846, filed on Jan. 16, 2020.

(51) Int. Cl.

| | |
|---|---|
| ***F04B 9/113*** | (2006.01) |
| ***E21B 43/26*** | (2006.01) |
| ***F04B 7/02*** | (2006.01) |
| ***F04B 15/02*** | (2006.01) |
| ***F04B 49/06*** | (2006.01) |

(52) U.S. Cl.

CPC ..... *F04B 9/113* (2013.01); *E21B 43/2607* (2020.05); *F04B 7/02* (2013.01); *F04B 15/02* (2013.01); *F04B 49/065* (2013.01)

(58) Field of Classification Search

CPC .. F04B 7/02; F04B 7/0266; F04B 7/04; F04B 9/08; F04B 9/10; F04B 9/113; F04B 15/02; F04B 23/04; F04B 53/12; F16K 27/00; F16K 27/0272; E21B 43/2607

USPC ..... 166/177.5

See application file for complete search history.

(56) References Cited

U.S. PATENT DOCUMENTS 3,000,320 A * 9/1961 Ring ..... F04B 43/067 417/567
3,280,833 A * 10/1966 Smith ..... F04B 9/115 251/324
3,385,267 A * 5/1968 Boegli ..... A01K 7/06 119/72.5
3,494,290 A * 2/1970 Schaible ..... F01L 25/08 92/58.1
3,500,855 A * 3/1970 Schaible et al. ..... F04B 9/1178 251/189
3,773,438 A 11/1973 Hall et al.
5,336,052 A * 8/1994 Zollner ..... F04B 15/02 417/205

(Continued)

OTHER PUBLICATIONS

International Search Report and Written Opinion; Apr. 22, 2021; 10 pages.

*Primary Examiner* — Devon C Kramer
*Assistant Examiner* — Chirag Jariwala
(74) *Attorney, Agent, or Firm* — Dunlap Codding, P.C.

(57) ABSTRACT

A fluid pump including a fluid end body having a plurality of interconnected fluid paths, a plurality of valves located within the plurality of interconnected fluid paths and a plunger located within at least one of the plurality of interconnected fluid paths to push a first portion of the volume of fluid through a first section of the plurality of interconnected fluid paths and from a second fluid port during a push stroke to push a second portion of the volume of fluid through a second section of the plurality of interconnected fluid paths and from the second fluid port during a back stroke. Each of the plurality of valves is movable between an open position and a closed position to form the first section and the second section.

8 Claims, 16 Drawing Sheets

(56) References Cited

U.S. PATENT DOCUMENTS

| | | | | |
|---|---|---|---|---|
| 2002/0092418 | A1* | 7/2002 | Hefren | F04B 15/02 92/258 |
| 2015/0101694 | A1* | 4/2015 | Forrest | F04B 53/164 137/861 |
| 2016/0032701 | A1 | 2/2016 | Young | |
| 2017/0204850 | A1 | 7/2017 | Graham et al. | |
| 2017/0292513 | A1 | 10/2017 | Haddad et al. | |
| 2018/0187537 | A1* | 7/2018 | Hill | F16L 41/03 |
| 2018/0266412 | A1 | 9/2018 | Stokkevag et al. | |
| 2018/0284816 | A1* | 10/2018 | Cook | G05D 7/0664 |
| 2018/0291892 | A1 | 10/2018 | Vicars | |
| 2020/0370548 | A1* | 11/2020 | Chady | F04B 53/10 |
| 2021/0396121 | A1* | 12/2021 | Wilson | F04B 49/20 |

* cited by examiner

FLUID PUMP ASSEMBLY

This application claims priority to the provisional patent application identified by U.S. Ser. No. 62/961,846, filed Jan. 16, 2020, the entire contents of which are hereby incorporated herein by reference.

BACKGROUND

The oil and gas industry's never-ending demand for higher fracking pressures and higher sand volumes is a well-known and sought-after quest. Fracking pressures and higher sand content pumping equipment have been greatly stressed due to well operators increasing demands. Fracking equipment "hours of operations" are diminishing under these extreme conditions. Well service companies are continuously replacing equipment at alarming rates and experiencing diminishing profit margins. Pump manufacturers continue to experiment with exotic metals to meet those demands and yet the valves and seats are still using the geometric designs of over sixty years ago. New efforts have been underway recently that utilize hydraulic intensifiers to pump the well bore fluids. These pumps are slower cycled thus reducing the number of strokes per minute which reduce the cycles of the valves and seat functions but still allow premature destruction of the old valve and valve seat components due to the negative sand effects on the metal components. Synchronizing hydraulic power and control systems powered by diesel/gas/propane/natural gas to electric generators are proven to be more energy efficient and dependable.

Existing fluid ends used in the oil and gas industry fracking business typically provide 100 to 500 hours operating time before requiring replacement. The angled fluid paths wash out during high pressure (HP) or high volume (HV) having high sand concentrations (50 to 100 microns).

Geometry of valves designs in the oil and gas industry have not changed over the decades, primarily in the sealing area (sq. ins.) and are generally metal seals. Valve designs being used in the industry control incoming low-pressure supply fluid and positive placed in the high-pressure control valve section of the fluid end for (HP) discharge into the well. Some valve designs use springs to help reposition the valves during their cycles, but the system is generally controlled by incoming and outgoing fluid pressures to control the valve seating and opening positions. These opening and closing operations are affected by the heavy sand concentrations and rapid deterioration of the pigmented sealing areas greatly accelerated once surface areas become pigmented.

Valve seat designs used in the oil and gas Industry have not changed along with the valves. Most improvements have been made only in the areas of metallurgy and are typically exotic and expensive materials. When standard metal valves engage metal seats during high pressure, high volume, or high sand concentration pump cycles, the sand particles become embedded in either or both of the components' surface sealing area. When the valves move away from the valve seat, parts of the metal from either component may be torn away leaving disfigured sealing areas which can then rapidly deteriorate. Valves, valve seats, and fluid end bodies are not only subjected to the extreme conditions as just described but also fall victim to premature destruction due to certain corrosive chemicals and acids needed for the fracking fluids to be effective on the well formation.

These components typically have life cycles of 50 to 100 hours of operation before they must be replaced at a great expense, and are rarely repaired in the field which means the frack unit must have a standby unit ready to take its place when the failed unit is pulled off the job and sent back to the shop for repairs. The non-productive time and costs are common knowledge in the oil patch.

Typical fluid ends are usually bolted to the pumping frame then bolted to the power delivery frame. The "overall length" of the couple assembly is subjected to extreme pressures that buckle or flex the overall length of the framework, therefore, causing fatigued areas at many junctures. These areas are prone to premature damage, metal degradation, rapid washouts or blowouts.

DETAILED DESCRIPTION OF EXEMPLARY EMBODIMENTS

Figure 1:
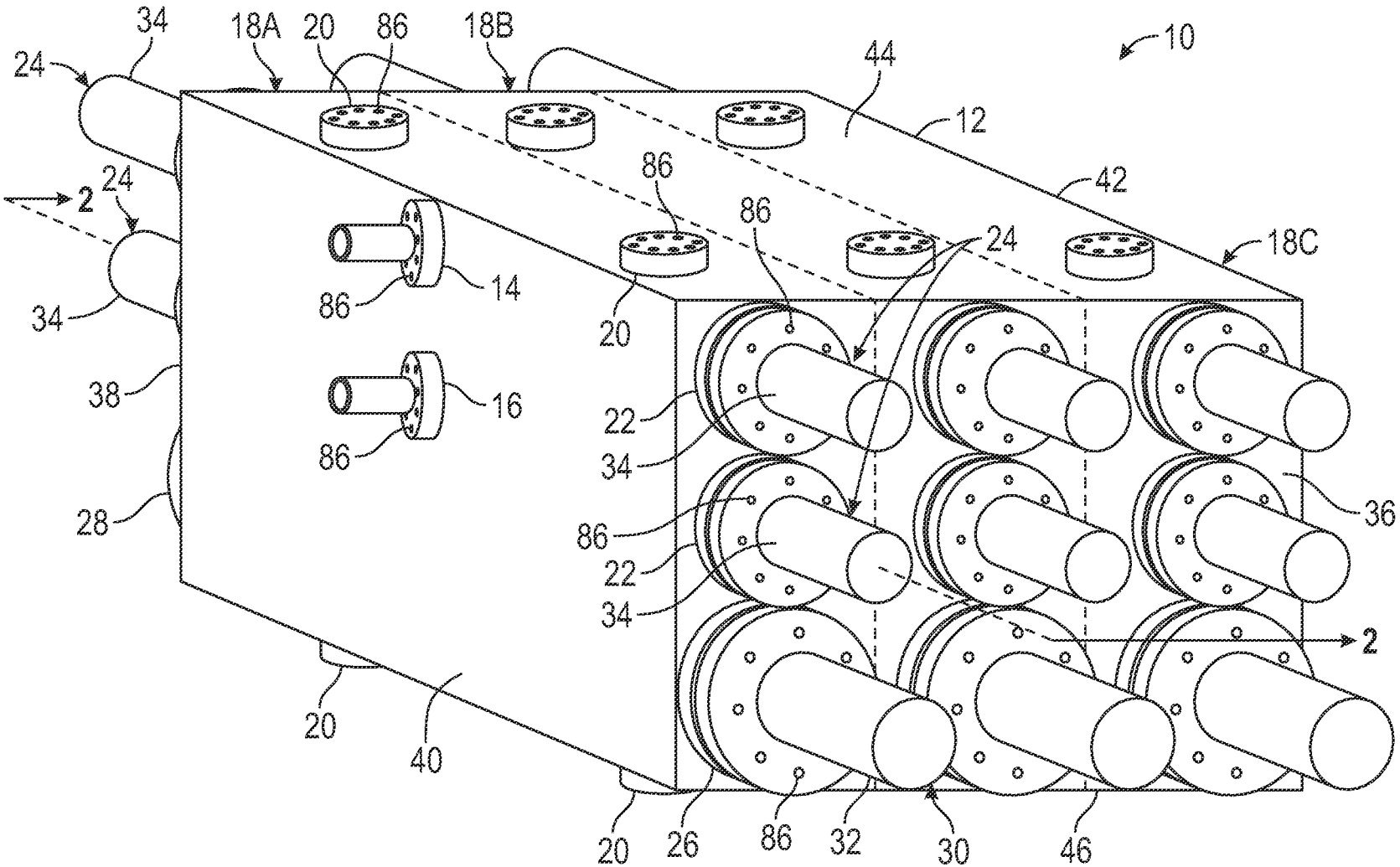
FIG. 1 is a perspective view of a fluid pump assembly constructed in accordance with the inventive concepts disclosed herein.

Before explaining at least one embodiment of the inventive concepts disclosed, it is to be understood that the inventive concepts are not limited in their application to the details of construction and the arrangement of the components or steps or methodologies in this description or illustrated in the drawings. The inventive concepts disclosed are capable of other embodiments or of being practiced or carried out in various ways. Also, it is to be understood that the phraseology and terminology employed is for description only and should not be regarded as limiting the inventive concepts disclosed and claimed herein.

In this detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features may not be described to avoid unnecessarily complicating the disclosure.

Further, unless stated to the contrary, "or" refers to an inclusive "or" and not to an exclusive "or." For example, a condition A or B is satisfied by anyone of: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts disclosed. This description should be read to include one or at least one and the singular also includes the plural unless it is obvious that it is meant otherwise.

As used herein any reference to "one embodiment" or "an embodiment" means that a particular element, feature, structure, or characteristic described in the embodiment is included in at least one embodiment. The appearances of the phrase "in one embodiment" in various places in the specification are not necessarily all referring to the same embodiment.

Circuitry, as used herein, may be analog and/or digital components, or one or more suitably programmed processors (e.g., microprocessors) and associated hardware and software, or hardwired logic. Also, "components" may perform one or more functions. The term "component," may include hardware, such as a processor (e.g., microprocessor), an application specific integrated circuit (ASIC), field programmable gate array (FPGA), a combination of hardware and software, and/or the like. The term "processor" as used herein means a single processor or multiple processors working independently or together to collectively perform a task.

Software may include one or more computer readable instructions that when executed by one or more components cause the component to perform a specified function. It should be understood that the algorithms described herein may be stored on one or more non-transitory computer readable medium. Exemplary non-transitory computer readable mediums may include random access memory, read only memory, flash memory, and/or the like. Such non-transitory computer readable mediums may be electrically based, magnetically based, optically based, and/or the like. Software modules are reusable portions of computer executable code having one or more specific functions.

Referring to the drawings, specifically FIG. 1, a fluid pump assembly 10 constructed in accordance with the inventive concepts disclosed herein is shown. The fluid pump assembly 10 includes a fluid end body 12, a first fluid port 14, a second fluid port 16, one or more veins 18, more specifically shown as a first vein 18A, a second vein 18B, and a third vein 18C. Each of the veins 18 comprises a plurality of vertical flow port flanges 20, a plurality of valve/seat sleeve retainer flanges 22, a plurality of hydraulic control valves 24, a front liner cage flange 26, a back liner cage flange 28, and a linear pump 30 having a linear pump hydraulic intensifier cylinder 32. Each of the plurality of hydraulic control valves 24 have a hydraulic control cylinder 34. For simplicity only, the elements of the first vein 18A are identified and described; however, it will be understood that each of the one or more vein 18, including the second vein 18B and the third vein 18C, are constructed in accordance with the construction of the first vein 18A.

The fluid end body 12 has a first end 36, a second end 38, a first side 40, a second side 42, a top side 44, and a bottom side 46. The first fluid port 14 and the second fluid port 16 are coupled to the first side 40 of the fluid end body 12. The plurality of vertical flow port flanges 20 are coupled to the top side 44 and the bottom side 46 of the fluid end body 12. The plurality of hydraulic control cylinders 34 are coupled to the plurality of valve/seat sleeve retainer flanges 22, which are coupled to the first end 36 and the second end 38 of the fluid end body 12. The linear pump hydraulic intensifier cylinder 32 is coupled to the front liner cage flange 26, which is coupled to the first end 36 of the fluid end body 12. The back liner cage flange 28 is coupled to the second end 38 of the fluid end body 12. Although the exemplary embodiment of the fluid pump assembly 10 shown in FIG. 1 comprises three veins 18A-18C, it will be understood that the fluid pump assembly 10 may comprise of any number of veins.

Figure 2:
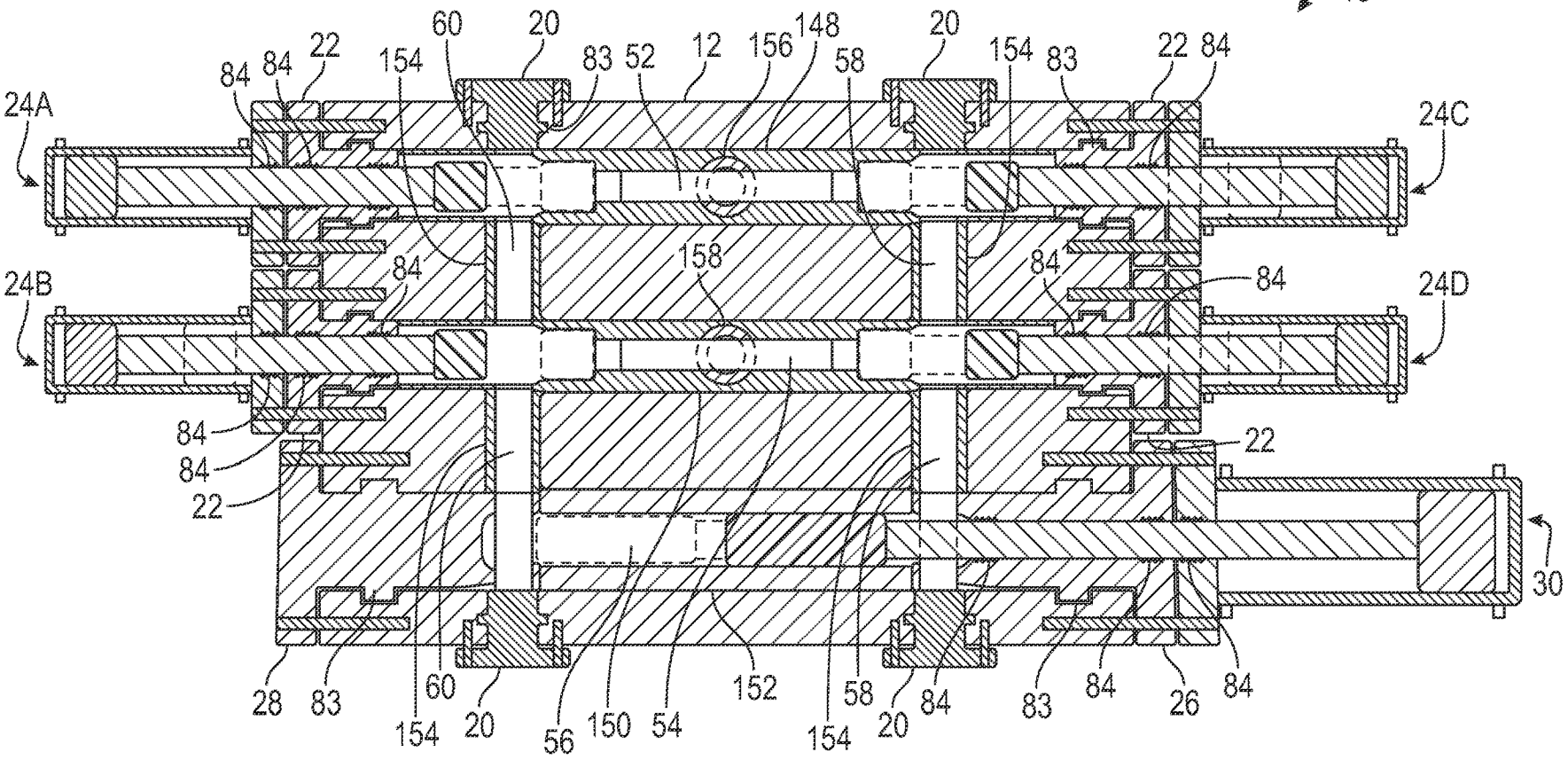
FIG. 2 is a sectional view of the fluid pump assembly of FIG. 1.

Turning now to FIG. 2, shown therein is a cross-sectional view of an exemplary embodiment of one of the one or more veins 18 of the fluid pump assembly 10 shown in FIG. 1 taken along lines 2-2. The vein 18 includes the fluid end body 12, the plurality of vertical flow port flanges 20, the plurality of valve/seat sleeve retainer flanges 22, the front liner cage flange 26, the back liner cage flange 28, the plurality of hydraulic control valves 24, and the linear pump 30. The vein 18 further includes a valve sleeve assembly.

Figure 3:
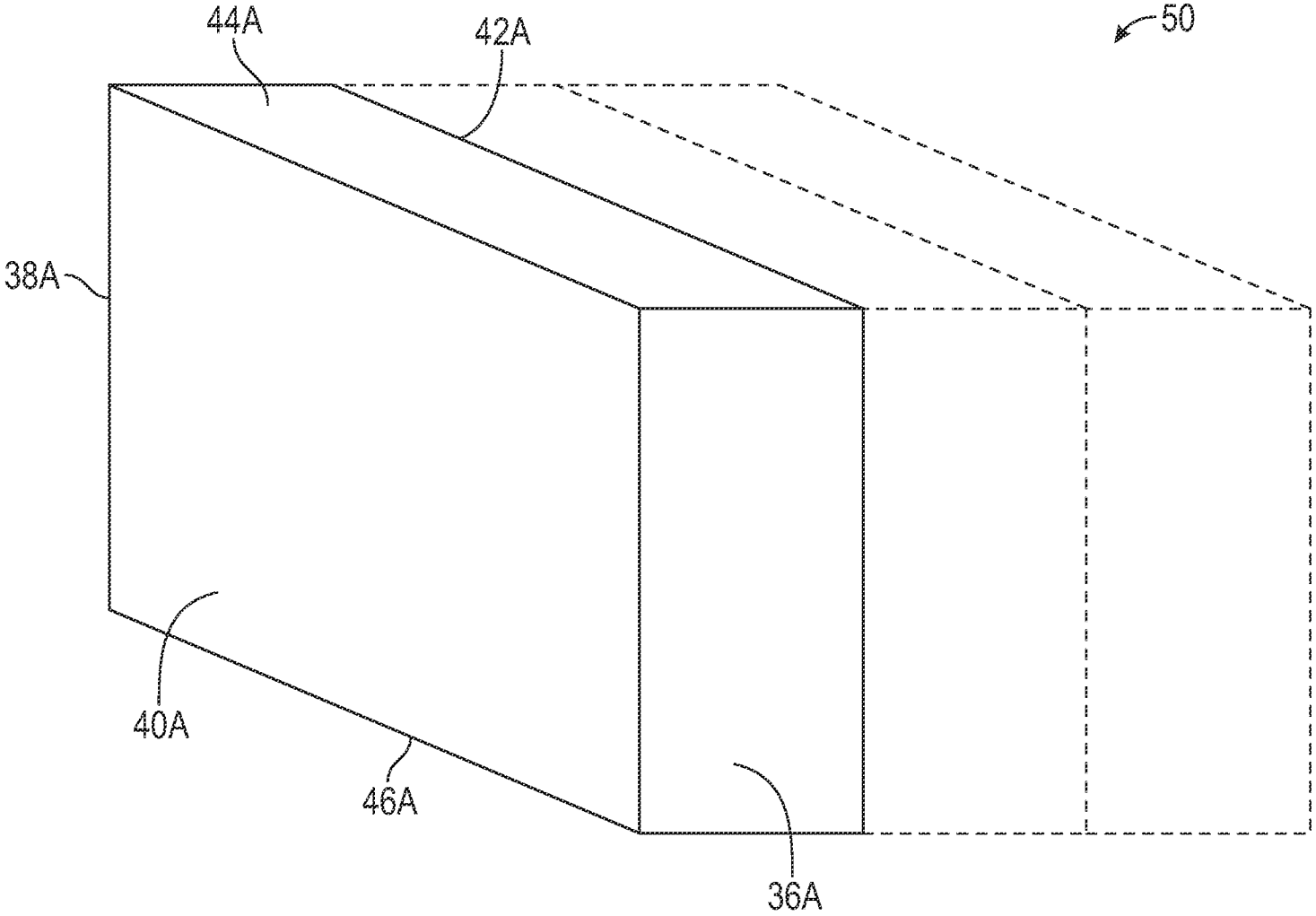
FIG. 3 is a perspective view of a one body block.

In one embodiment, the fluid end body 12 may be constructed from a one body block 50 (FIG. 3). The one body block 50 provides unique frame load control by utilizing a solid body structure in the form of a rectangular cuboid having a first end 36A, a second end 38A, a first side 40A, a second side 42A, a top side 44A, a bottom side 46A. The size of the one body block 50 may vary based on several factors, including but not limited to, fluid pressure requirements, fluid-flow volume requirements, and number of veins. The size of the veins and width of the transport vehicle may be the only limiting factors per pump unit. This being said, the size of a typical one-vein pump may be approximately 54 inches by approximately 14 inches by approximately 34 inches. The one body block 50 may be fabricated of any suitable material capable of withstanding high internal pressures, such as stainless steel, high carbon steel, and the like.

Figure 4:
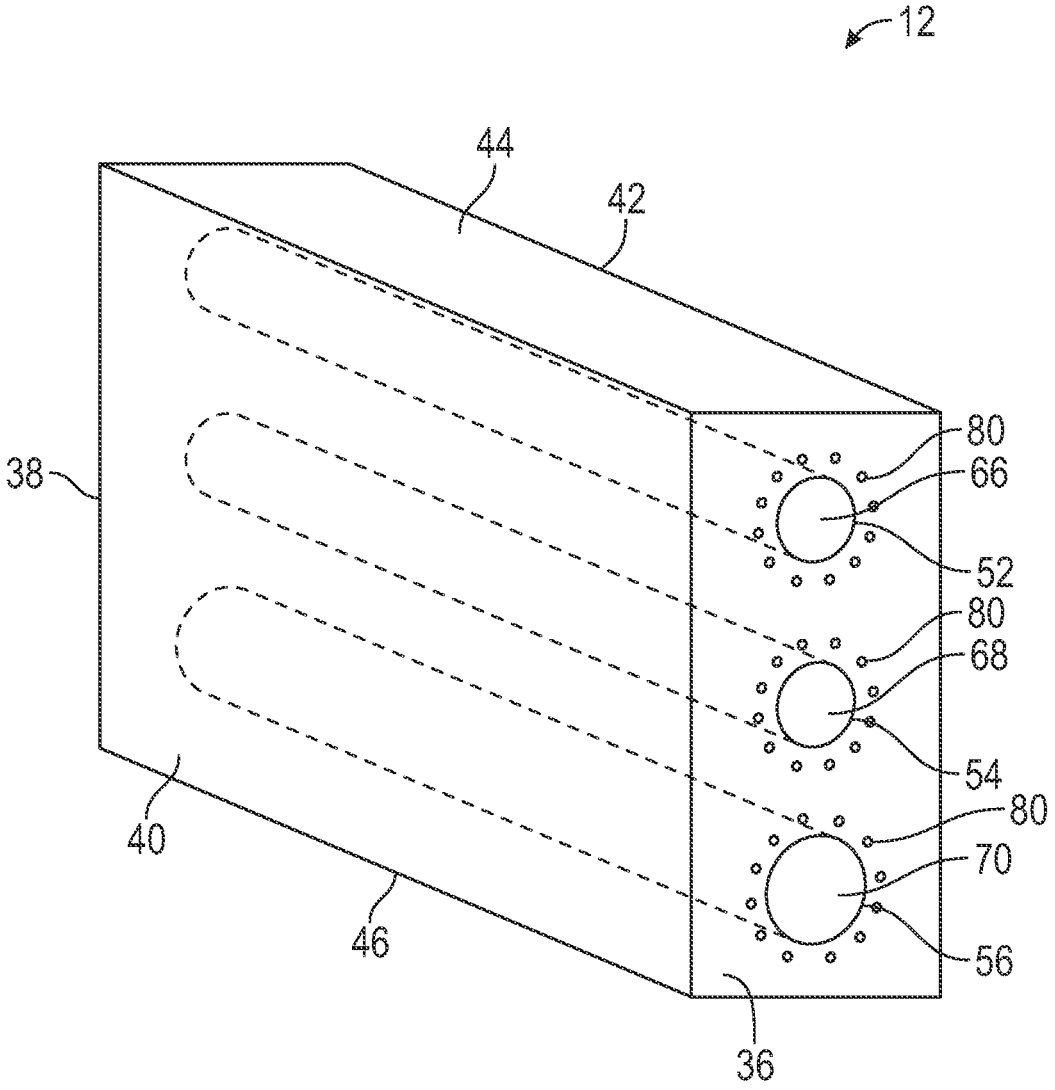
FIG. 4 is a perspective view of the fluid end body having a first horizontal fluid path, a second horizontal fluid path, and a pump piston fluid path.
Figure 5:
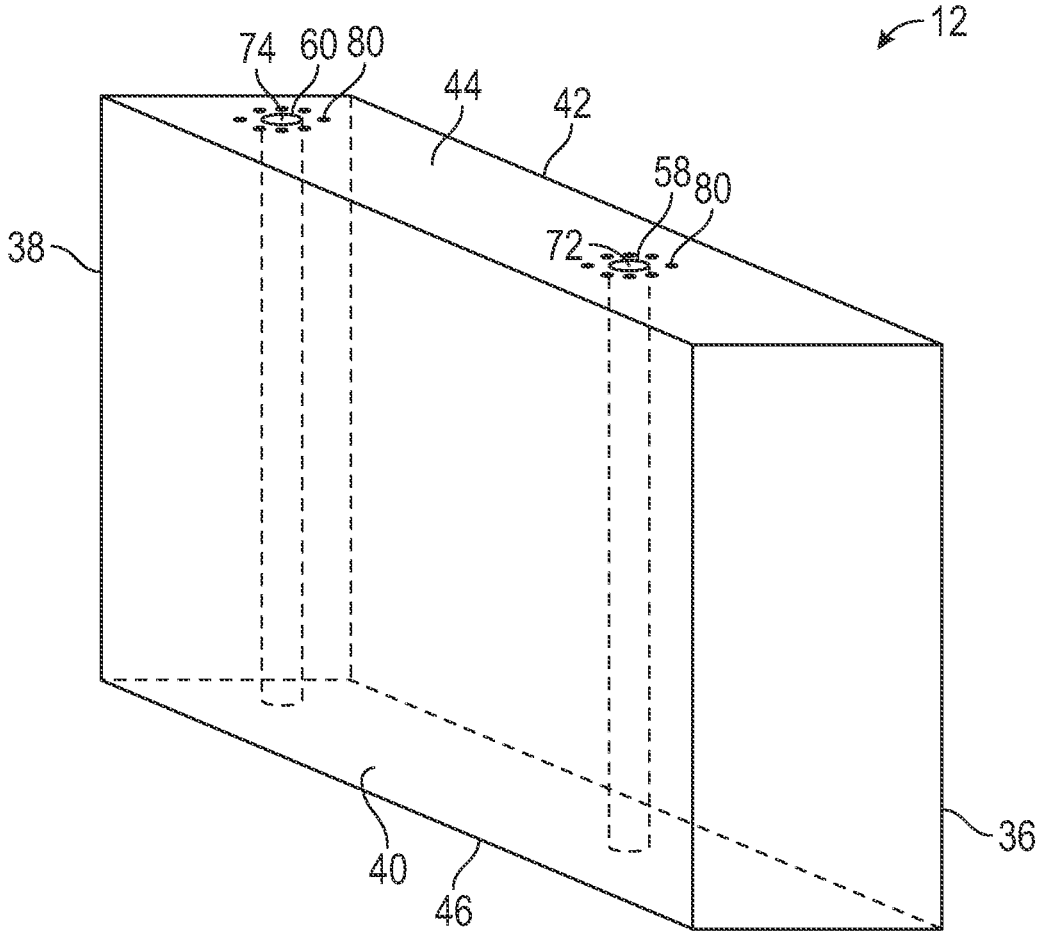
FIG. 5 is a perspective view of the fluid end body having a first vertical fluid path and a second vertical fluid path.
Figure 6:
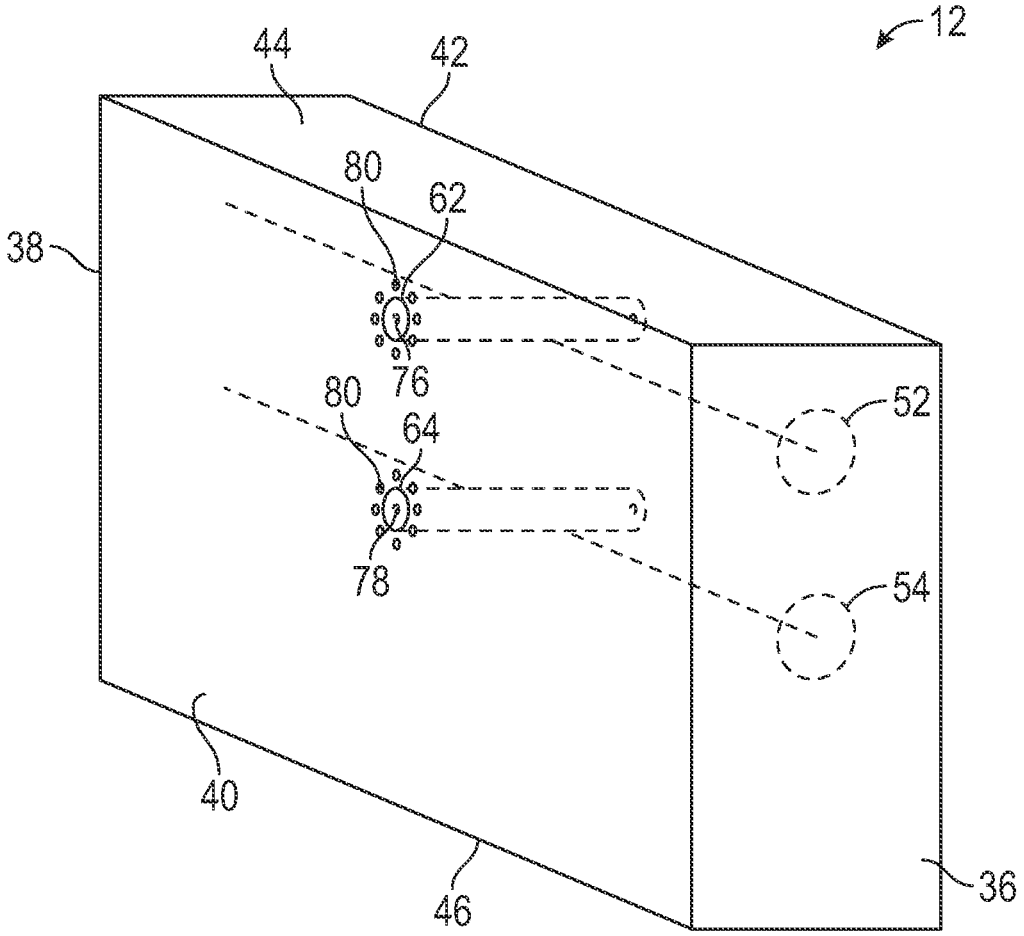
FIG. 6 is a perspective view of the fluid end body having a fluid inlet path and an outlet fluid path.

As depicted in FIGS. 4-6, the vein 18 further includes a plurality of interconnected fluid paths. The plurality of interconnected fluid paths includes a first horizontal fluid path 52, a second horizontal fluid path 54, a pump piston fluid path 56, a first vertical fluid path 58, a second vertical fluid path 60, an inlet fluid path 62, and an outlet fluid path 64. The first horizontal fluid path 52 is defined by an inner surface 66 of the fluid end body 12 extending longitudinally between the first end 36 and the second end 38 and spaced between the top side 44 and the bottom side 46 and between the first side 40 and the second side 42 (FIG. 4). The second horizontal fluid path 54 is defined by an inner surface 68 of the fluid end body 12 extending longitudinally between the first end 36 and the second end 38 and spaced between the top side 44 and the bottom side 46 and between the first side 40 and the second side 42 (FIG. 4).

The pump piston fluid path 56 is defined by an inner surface 70 of the fluid end body 12 extending longitudinally between the first end 36 and the second end 38 and spaced between the top side 44 and the bottom side 46 and between the first side 40 and the second side 42 (FIG. 4). The first vertical fluid path 58 is defined by an inner surface 72 of the fluid end body 12 extending longitudinally between the top side 44 and the bottom side 46 spaced between the first end 36 and second end 38 and between the first side 40 and the second side 42 (FIG. 5). The second vertical fluid path 60 is defined by an inner surface 74 of the fluid end body 12 extending longitudinally between the top side 44 and the bottom side 46 spaced between the first end 36 and second end 38 and between the first side 40 and the second side 42 (FIG. 5). The first vertical fluid path 58 and the second vertical fluid path 60 intersect with the first horizontal fluid path 52, a second horizontal fluid path 54, and a pump piston fluid path 56. The inlet fluid path 62 is defined by an inner surface 76 of the fluid end body 12 extending from the first side 40 to the second side 42 of the fluid end body 12 intersecting the first horizontal fluid path 52 of each of the one or more veins 18 (FIG. 6). The inlet fluid path 62 is interposed between the first vertical fluid path 58 and the second vertical fluid path 60. The inlet fluid path 62 is in fluid communication with the first fluid port 14. The outlet fluid path 64 is defined by an inner surface 78 of the fluid end body 12 extending from the first side 40 to the second side 42 of the fluid end body 12 intersecting the second horizontal fluid path 54 of each of the one or more veins 18 (FIG. 6). The outlet fluid path 64 is interposed between the first vertical fluid path 58 and the second vertical fluid path 60. The outlet fluid path 64 is in fluid communication with the second fluid port 16. The first horizontal fluid path 52, the second horizontal fluid path 54, the pump piston fluid path 56, the first vertical fluid path 58, the second vertical fluid path 60, the inlet fluid path 62, and the outlet fluid path 64 are all in fluid communication with each other. The one body block 50 may include a plurality of threaded bore holes 80 spaced in a circular pattern about each of the plurality of interconnected fluid paths on the first end 36, a second end 38, the first side 40, the second side 42, the top side 44, and the bottom side 46.

The plurality of interconnected fluid paths may be formed during the casting of the one body block 50, drilled out of the one body block 50, or any combination thereof. In one embodiment, the first horizontal fluid path 52 and the second horizontal fluid path 54 have a uniform diameter of approximately 6 inches, the pump piston fluid path 56 has uniform diameter of approximately 8 inches, and the first vertical fluid path 58, the second vertical fluid path, the inlet fluid path, and the outlet fluid path 64 have a uniform diameter of approximately 4 inches.

Each of the plurality of vertical flow port flanges 20 may be positioned against at least one of the top side 44 or the bottom side 46, centered on the first vertical fluid path 58 or the second vertical fluid path 60. Each of the plurality of vertical flow port flanges 20 may be a blind long weld neck flange operable to seal the first vertical fluid path 58 and the second vertical fluid path 60 to block the flow of fluid. In one embodiment, each of the plurality of vertical flow port flanges 20 may include a neck portion 82 that extends into at least a portion of the first vertical fluid path 58 or the second vertical fluid path 60. The neck portion 82 may include an interlocking member 83 extending radially from the neck portion 82, configured to engage with at least a portion of the inner surface 72, 74 of the first vertical fluid path 58 or the second vertical fluid path 60. Each of the plurality of vertical flow port flanges 20 include a seal 84 to block the flow of fluid between the neck portion 82 and the inner surface 72,74 of the first vertical fluid path 58 or the second vertical fluid path 60.

In one embodiment, each of the plurality of valve/seat sleeve retainer flanges 22 are positioned against at least one of the first end 36 or the second end 38, centered on the first horizontal fluid path 52 or the second horizontal fluid path 54. Each of the plurality of valve/seat sleeve retainer flanges 22 may be a long weld neck flange. In one embodiment, each of the plurality of valve/seat sleeve retainer flanges 22 may include a neck portion 82 that extends into at least a portion of the first horizontal fluid path 52 or the second horizontal fluid path 54. The neck portion 82 may include an interlocking member 83 extending radially from the neck portion 82, configured to engage with at least a portion of the inner surface 72, 74 of the first horizontal fluid path 52 or the second horizontal fluid path 54. Each of the plurality of valve/seat sleeve retainer flanges 22 include a seal 84 to block the flow of fluid between the neck portion 82 and the inner surface 66, 68 of the first horizontal fluid path 52 or the second horizontal fluid path 54.

The front liner cage flange 26 is positioned against the first end 36, centered on the pump piston fluid path 56. The front liner cage flange 26 may be a long weld neck flange. In one embodiment, the front liner cage flange 26 may include a neck portion 82 that extends into at least a portion of the pump piston fluid path 56. In one embodiment, the neck portion 82 may extend into the pump piston fluid path 56 past the intersection of the first vertical fluid path 58 and the pump piston fluid path 56. The neck portion 82 may be configured to permit the unrestricted flow of fluid between the first vertical fluid path 58 and the pump piston fluid path 56. The neck portion 82 may include an interlocking member 83 extending radially from the neck portion 82, configured to engage with at least a portion of the inner surface 70 of the pump piston fluid path 56. The front liner cage flange 26 includes a seal 84 to block the flow of fluid between the neck portion 82 and the inner surface 70 of the pump piston fluid path 56.

The back liner cage flange 28 is positioned against at the second end 38, centered on the pump piston fluid path 56. The back liner cage flange 28 may be a blind long weld neck flange operable to seal the pump piston fluid path 56 to block the flow of fluid. In one embodiment, the back liner cage flange 28 may include a neck portion 82 that extends into at least a portion of the pump piston fluid path 56. In one embodiment, the neck portion 82 may extend into the pump piston fluid path 56 past the intersection of the second vertical fluid path 60 and the pump piston fluid path 56. The neck portion 82 may be configured to permit the unrestricted flow of fluid between the second vertical fluid path 60 and the pump piston fluid path 56. The neck portion 82 may include an interlocking member 83 extending radially from the neck portion 82, configured to engage with at least a portion of the inner surface 70 of the pump piston fluid path 56. The back liner cage flange 28 includes a seal 84 to block the flow of fluid between the neck portion 82 and the inner surface 70 of the pump piston fluid path 56. The neck portion 82 may include an interlocking member 83 extending radially from the neck portion 82, configured to engage with at least a portion of the inner surface 72, 74 of the first vertical fluid path 58 or the second vertical fluid path 60. Each of the plurality of vertical flow port flanges 20 include a seal 84 to block the flow of fluid between the neck portion 82 and the inner surface 72,74 of the first vertical fluid path 58 or the second vertical fluid path 60.

Each of the plurality of vertical flow port flanges 20, the plurality of valve/seat sleeve retainer flanges 22, the front liner cage flange 26, back liner cage flange 28 may include a plurality of bore holes 86 spaced in a circular pattern about the flange that align with the plurality of threaded bore holes 80 of the one body block 50, such that a plurality of fasteners may be used to attach the plurality of flanges to the fluid end body 12.

Figure 7A:
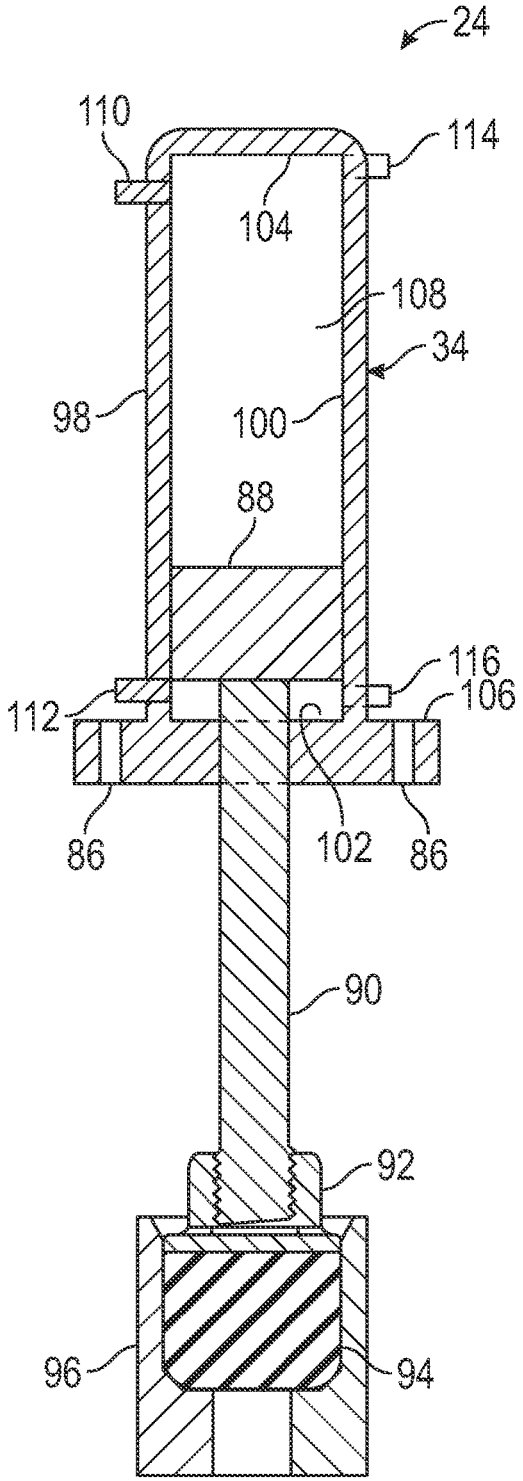
FIG. 7A is a sectional view of a hydraulic control valve.

In FIG. 7A, the plurality of hydraulic control valves 24 includes a first valve assembly 24A, a second valve assembly 24B, a third valve assembly 24C, and a fourth valve assembly 24D. Each of the plurality of hydraulic control valves 24 may include the hydraulic control cylinder 34, a valve piston head 88, a valve shaft 90, a valve body 92, a valve head 94, and a valve seat 96.

The hydraulic control cylinder 34 may comprise a cylindrical member having an outer wall 98, an inner wall 100, a proximal wall 102, and a distal wall 104. In one embodiment, the proximal wall 102 may include a hydraulic cylinder flange 106. The hydraulic cylinder flange 106 may include a plurality of bore holes 86 spaced in a circular pattern about the hydraulic cylinder flange 106 that align with the plurality of bore holes 86 of the plurality of valve/seat sleeve retainer flanges 22 and the plurality of threaded bore holes 80 of the one body block 50, such that a plurality of fasteners may be used to attach the hydraulic control cylinder 34 to the each of the plurality of valve/seat sleeve retainer flanges 22 and the fluid end body 12. The hydraulic control cylinder 24 has a valve cylinder cavity 108 defined by the inner wall 100, the proximal wall 102, and the distal wall 104.

In one embodiment, the hydraulic control cylinder 34 may further include a first port 110, a second port 112, a first sensor 114, and a second sensor 116. The first port 110 may be positioned between the outer wall 98 and inner wall 100 proximate to the distal wall 104 and operable to allow hydraulic fluid to be pumped into and out of the valve cylinder cavity 108 between the valve piston head 88 and the distal wall 104. The second port 112 may be positioned between the outer wall 98 and inner wall 100 proximate to the proximal wall 102 and operable to allow hydraulic fluid to be pumped into and out of the valve cylinder cavity 108 between the valve piston head 88 and the proximal wall 102. The first sensor 114 may be positioned internally and/or externally to the valve cylinder cavity 108 proximate to the distal wall 104 and operable to transmit a signal when the valve piston head 88 is within a predetermined distance to the distal wall 104. The second sensor 116 may be positioned internally and/or externally to the valve cylinder cavity 108 proximate to the proximal wall 102 and operable to transmit a signal when the valve piston head 88 is within a predetermined distance to the proximal wall 102.

The valve piston head 88 may be a cylindrical member having substantially similar cross section as the valve cylinder cavity 108 of the hydraulic control cylinder 34. The valve piston head 88 is slidably disposed within the valve cylinder cavity 108 of the hydraulic control cylinder 34 such that the valve piston head 88 may be hydraulically moved back and forth between the proximal wall 102 and the distal wall 104 while maintaining a hydraulic seal within the valve cylinder cavity 108. The valve piston head 88 is attached to the valve shaft 90 which extends longitudinally through the proximal wall 102. The valve shaft 90 extends longitudinally from the valve piston head 88, through the proximal wall 102, through the valve/seat sleeve retainer flanges 22, and into at least one of the first horizontal fluid path 52 or the second horizontal fluid path 54. The valve body 92 is located within at least one of the first horizontal fluid path 52 or the second horizontal fluid path 54 attached at the opposite end of the valve shaft 90 from the valve piston head 88. The valve body 92 provides a rigid structure to which the valve head 94 is attached. In one embodiment, the valve head 94 may comprise a cylindrical shape having uniform diameter of approximately 4 inches, a length of approximately 4 inches, and a chamfered end.

In one embodiment, the valve seat 96 may be constructed of a metal material, and have a tubular section with an inner diameter of approximately 4 inches with an inward taper at one end. The tapered end has an opening to allow fluid to pass through the valve seat 96 with an inner diameter that is smaller than the inner diameter of the tubular section. The valve seats 96 located in the first horizontal fluid path 52 are interposed between the first fluid port 14 and each of the first vertical fluid path 58 and the second vertical fluid path 60, and the valve seats 96 that are located in the second horizontal fluid path 54 are interposed between the second fluid port 16 and each of the first vertical fluid path 58 and the second vertical fluid path 60. The shape and size of the valve seat 96 substantially corresponds to and aligns with the shape and size of the valve head 94, such that the valve head 94 may be inserted into the valve seat 96 to prevent the flow of fluid through the valve seat 96. Specifically, the cylindrical wall and chamfer of the valve head 94 form a sealing surface with the tubular wall and taper of the valve seat 96. The valve seat 96 of the present invention provides 400% to 600% more sealing area by having the sealing surface areas of the valve seat 96 equal to the sealing surface areas of the valve head 94.

When the valve piston head 88 is adjacent to the distal wall 104 and the valve head 94 is disengaged from the valve seat 96 such that fluid can flow through the valve, the hydraulic control valve 24 is in an "open" position. When the valve piston head 88 is adjacent to the proximal wall 102 and the valve head 94 is sealingly engaged with the valve seat 96 such that fluid cannot flow through the valve, the hydraulic control valve 24 is in a "closed" position. In one embodiment, the hydraulic control valve 24 moves from the open position to the closed position, or from the closed position to the open position in approximately 0.3 seconds.

In one embodiment, the valve head 94 may be constructed of a rubber material, such that it may comprise 60 to 90 Buna (Nitrile), but is not limited to this material. Many other rubber or plastic materials exist for different operations that may occur, depending on the mix of chemicals, and temperature of the well bore. The rubber material may be bonded or molded onto a valve body 92 to ensure dependable life cycles of opening and closing against the valve seats under high pressures. In one embodiment, the valve head 94 may be incorporated into a "quick change out sleeve" that can be quickly changed out on the job site, thereby reducing expensive non-productive time and expensive standby units. The valve head 94 constructed of a rubber material may provide a more dependable seal when in contact with the valve seat 96 constructed of metal, as well as, preventing the sand from invading the valve seat 96 metal material.

As the valve piston head 88 is hydraulically moved within the valve cylinder cavity 108 of the hydraulic control cylinder 34, the valve shaft 90 is longitudinally moved back and forth through the proximal wall 102 and into at least one of the first horizontal fluid path 52 or the second horizontal fluid path 54, thereby causing the valve head 94 to be moved in and out of the valve seat 96. In one embodiment, the plurality of hydraulic control valves 24 may include the seal 84 between the valve shaft 90 and the proximal wall 102 to provide a hydraulic seal for the valve cylinder cavity 108. Additionally, one or more seals 84 may be located between the valve shaft 90 and the valve/seat sleeve retainer flanges 22 to provide a fluid seal for the fluid end body 12.

Figure 7B:
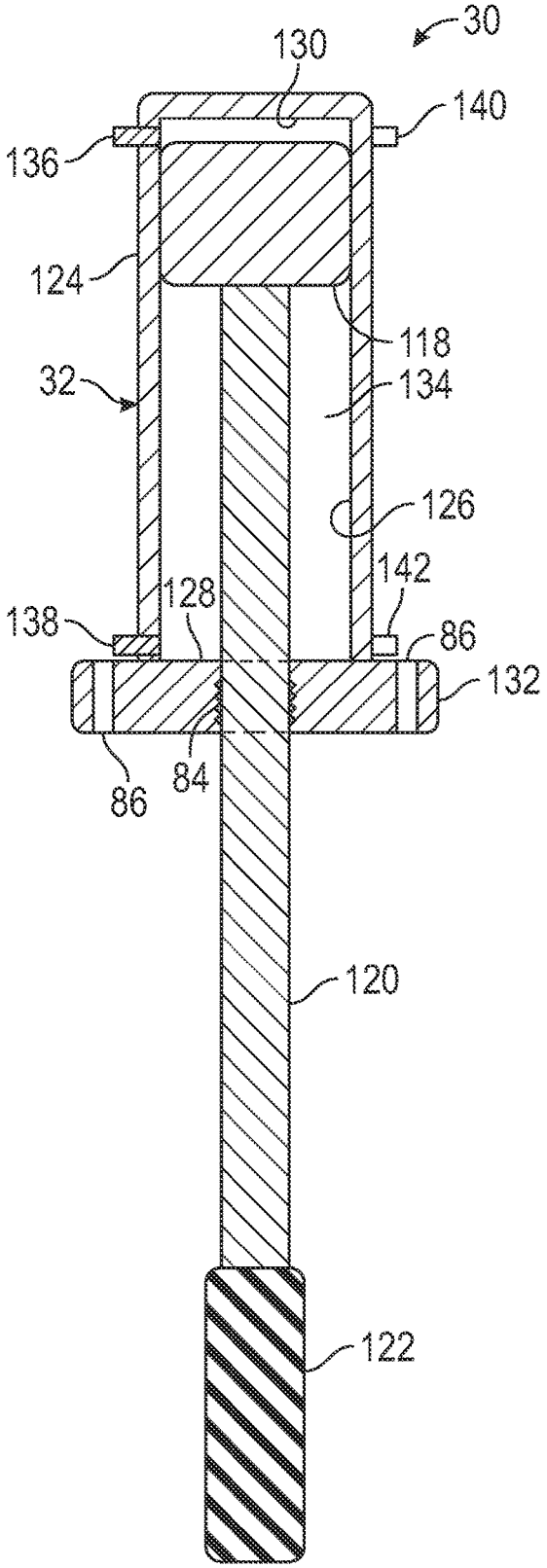
FIG. 7B is a sectional view of a linear pump.

In one embodiment shown in FIG. 7B, the linear pump 30 includes the linear pump hydraulic intensifier cylinder 32, a pump piston head 118, a pump shaft 120, and a pump plunger 122.

The linear pump hydraulic intensifier cylinder 32 may comprise a cylindrical member having an outer wall 124, an inner wall 126, a proximal wall 128, and a distal wall 130. In one embodiment, the proximal wall 128 may include a hydraulic cylinder flange 132. The hydraulic cylinder flange 132 may include a plurality of bore holes 86 spaced in a circular pattern about the hydraulic cylinder flange 132 that align with the plurality of bore holes 86 of the front liner cage flange 26 and the plurality of threaded bore holes 80 of the one body block 50, such that a plurality of fasteners may be used to attach the linear pump hydraulic intensifier cylinder 32 to the front liner cage flange 26 and the fluid end body 12. The linear pump hydraulic intensifier cylinder 32 has a pump cylinder cavity 134 defined by the inner wall 126, the proximal wall 128, and the distal wall 130.

In one embodiment, the linear pump hydraulic intensifier cylinder 32 may further include a first port 136, a second port 138, a first sensor 140, and a second sensor 142. The first port 136 may be positioned between the outer wall 124 and inner wall 126 proximate to the distal wall 130 and operable to allow hydraulic fluid to be pumped into and out of the pump cylinder cavity 134 between the pump piston head 118 and the distal wall 130. The second port 138 may be positioned between the outer wall 124 and inner wall 126 proximate to the proximal wall 128 and operable to allow hydraulic fluid to be pumped into and out of the pump cylinder cavity 134 between the pump piston head 118 and the proximal wall 128. The first sensor 140 may be positioned internally and/or externally to the pump cylinder cavity 134 proximate to the distal wall 130 and operable to transmit a signal when the pump piston head 118 is within a predetermined distance to the distal wall 130. The second sensor 142 may be positioned internally and/or externally to the pump cylinder cavity 134 proximate to the proximal wall 128 and operable to transmit a signal when the pump piston head 118 is within a predetermined distance to the proximal wall 128.

The pump piston head 118 may be a cylindrical member having substantially similar cross section as the pump cylinder cavity 134 of the linear pump hydraulic intensifier cylinder 32. The pump piston head 118 is slidably disposed within the pump cylinder cavity 134 of the linear pump hydraulic intensifier cylinder 32 such that the pump piston head 118 may be hydraulically moved back and forth between the proximal wall 128 and the distal wall 130 while maintaining a hydraulic seal within the pump cylinder cavity 134. The pump piston head 118 is attached to the pump shaft 120 which extends longitudinally through the proximal wall 128.

In one embodiment, the pump shaft 120 extends longitudinally from the pump piston head 118, through the proximal wall 128, through the front liner cage flange 26, and into the pump piston fluid path 56. The pump plunger 122 may be positioned within the pump piston fluid path 56 attached to the pump shaft 120. In one embodiment, the pump plunger 122 may be constructed of a rubber material having a cylindrical shape including a front side 144 and a back side 146. The diameter of the pump plunger 122 may be only slightly smaller than the pump piston fluid path 56. The pump plunger 122 is operable to facilitate the movement of fluid within the plurality of interconnected fluid paths as the pump plunger is hydraulically moved longitudinally within the pump piston fluid path 56.

The linear pump 30 is operable to conduct a "push stroke" and a "back stroke" within the pump piston fluid path 56. The push stroke occurs when the pump piston head 118 is hydraulically moved from adjacent to the distal wall 130 to adjacent to the proximal wall 128, moving the pump plunger 122 toward the second end 38 and displacing the fluid on the front side 144 of the pump plunger 122. The back stroke occurs when the pump piston head 118 is hydraulically moved in reverse, from the proximal wall 128 to the distal wall 130, moving the pump plunger 122 from the second end 38 to the first end 36 and displacing the fluid on the back side 146 of the pump plunger 122. In one embodiment, a duration of the push stroke and/or a duration of the back stroke is approximately 0.5 seconds. In other embodiments, the duration of the push stroke and the duration of the back stroke are not the same duration. The front side 144 of the pump plunger 122 has a surface area greater than the back side 146 of the pump plunger 122, therefore the fluid pump assembly 10 moves more fluid during the push stroke than the back stroke. The back side 146 has less surface area due to the pump shaft 120, which is causing the pump plunger 122 to move within the pump piston fluid path 56.

In one embodiment, the linear pump 30 may include the seal 84 between the pump shaft 120 and the proximal wall 128 to provide a hydraulic seal for the pump cylinder cavity 134. Additionally, one or more seals 84 may be located between the pump shaft 120 and the pump piston fluid path 56 to provide a fluid seal for the fluid end body 12.

Figure 8:
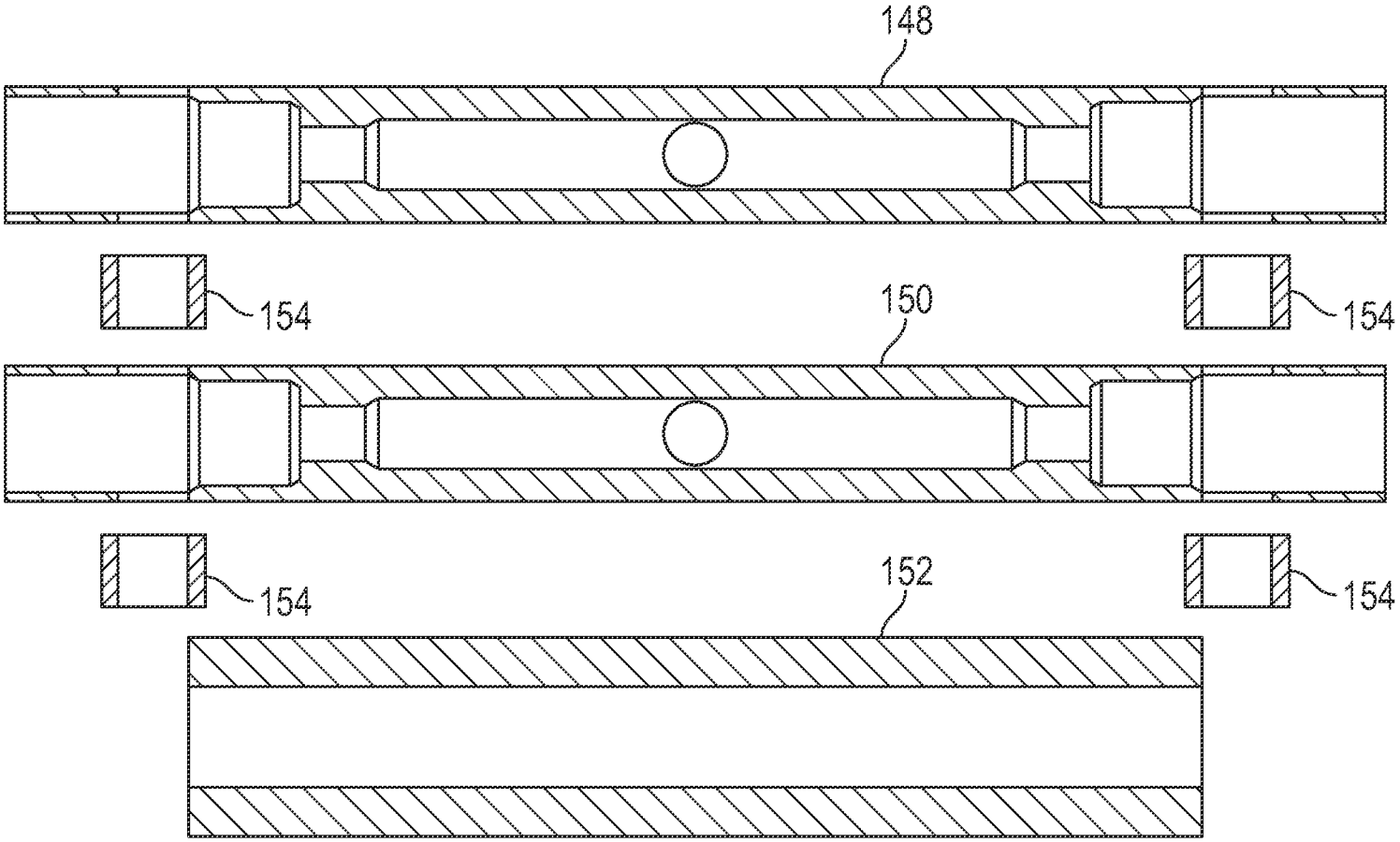
FIG. 8 is a sectional view of a valve sleeve assembly.

The valve sleeve assembly protects the plurality of interconnected fluid paths of the fluid end body 12 by providing a physical protective barrier between the inner surfaces 66,68,70,72,74, 76, 78 of the fluid end body 12 and the fluid within the plurality of interconnected fluid paths. As shown in FIG. 8, the valve sleeve assembly includes a first horizontal fluid path sleeve 148, a second horizontal fluid path sleeve 150, a pump fluid path sleeve 152, and one or more vertical fluid path sleeve 154. Although not shown in FIG. 8, the valve sleeve assembly further includes an inlet fluid path sleeve 156 and an outlet fluid path sleeve 158. Each of the first horizontal fluid path sleeve 148, the second horizontal fluid path sleeve 150, the pump fluid path sleeve 152, the one or more vertical fluid path sleeve 154, the inlet fluid path sleeve 156, and the outlet fluid path sleeve 158 may be tubular in shape, having an outer surface with an outer diameter and an inner surface with an inner diameter.

Figure 9:
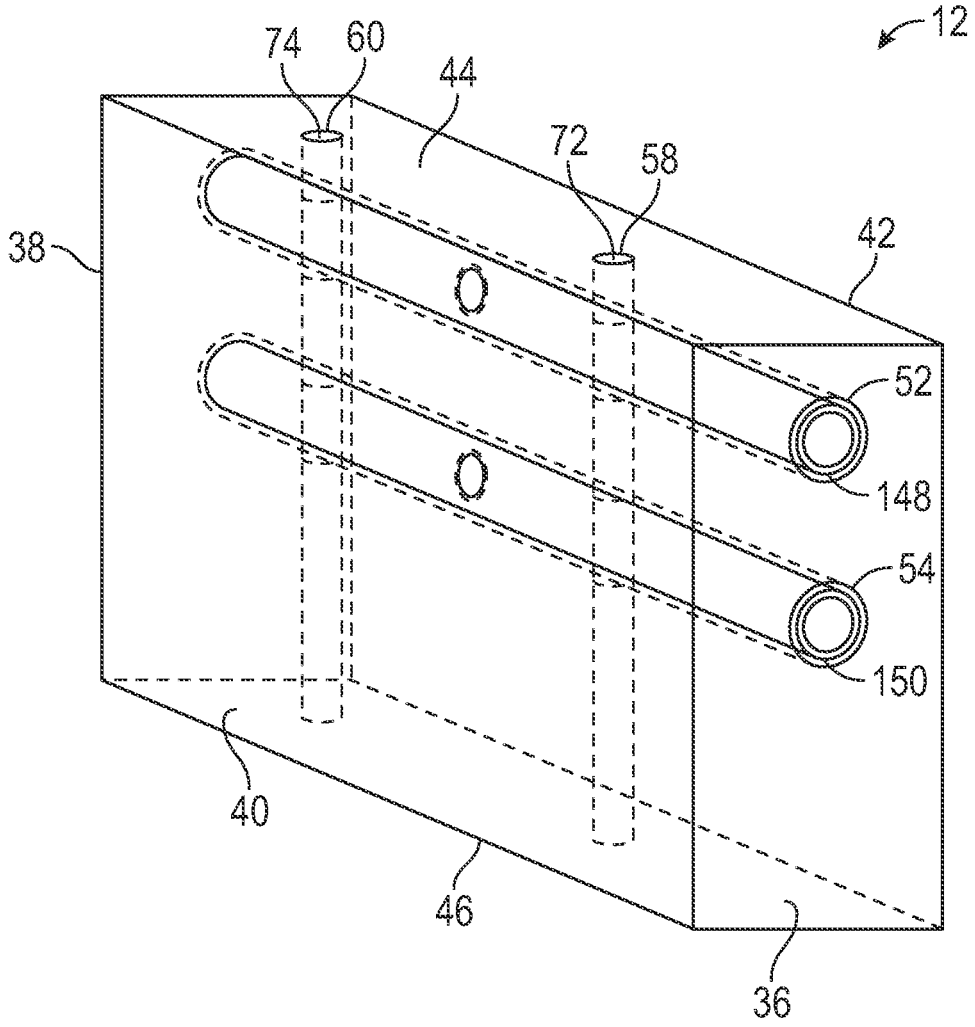
FIG. 9 is a perspective view of the fluid end body showing a first horizontal sleeve within the first horizontal fluid path and a second horizontal sleeve within the second horizontal fluid path.

As shown in FIG. 9, the first horizontal fluid path sleeve 148 and the second horizontal fluid path sleeve 150 are positioned within the first horizontal fluid path 52 and the second horizontal fluid path 54, respectively, and may be locked into place by the plurality of valve/seat sleeve retainer flanges 22. In one embodiment, the valve seats 96 are incorporated into the first horizontal fluid path sleeve 148 and the second horizontal fluid path sleeve 150. The first horizontal fluid path sleeve 148 includes a plurality of holes extending through the outer surface to the inner surface, located at the intersection between the first horizontal fluid path 52 and each of the first vertical fluid path 58, second vertical fluid path 60, and the inlet fluid path 62. The second horizontal fluid path sleeve 150 includes a plurality of holes extending through the outer surface to the inner surface, located at the intersection between the second horizontal fluid path 54 and each of the first vertical fluid path 58, second vertical fluid path 60, and the outlet fluid path 64 to maintain fluid communication between the plurality of interconnected fluid paths, and more specifically, between the plurality of sleeves. The first horizontal fluid path sleeve 148 or the second horizontal fluid path sleeve 150 may be removed from the first horizontal fluid path 52 and the second horizontal fluid path 54 and quickly changed out by removing the at least one of the plurality of valve/seat sleeve retainer flanges 22 from the fluid end body 12.

In one embodiment, the plurality of hydraulic control valves 24 may be individually positioned to isolate different sections of the plurality of interconnected fluid paths from other sections. In one embodiment, the positioning of the plurality of hydraulic control valves 24 forms a first section, a second section, a third section and a fourth section of the plurality of interconnected fluid paths. For example, the first section may include a portion of the pump piston fluid path 56 between the front side 144 of the pump plunger 122 and the second vertical fluid path 60, the second vertical fluid path 60, the portion of the second horizontal fluid path 54 between the second vertical fluid path 60 and the closed valve head 94 of the fourth valve assembly 24D, and the outlet fluid path 64. The second section may include a portion of the pump piston fluid path 56 between the back side 146 of the pump plunger 122 and the first vertical fluid path 58, the first vertical fluid path 58, the portion of the second horizontal fluid path 54 between the second vertical fluid path 60 and the closed valve head 94 of the second valve assembly 24B, and the outlet fluid path 64. The third section may include inlet fluid path 62, a portion of the first horizontal fluid path 52 between the closed valve head 94 of the third valve assembly 24C and the second vertical fluid path 60, the second vertical fluid path 60, and the portion between the front side 144 of the pump plunger 122 and the second vertical fluid path 60. The third section may include inlet fluid path 62, a portion of the first horizontal fluid path 52 between the closed valve head 94 of the first valve assembly 24A and the first vertical fluid path 58, the first vertical fluid path 58, and the portion between the back side 146 of the pump plunger 122 and the first vertical fluid path 58.

Figure 10:
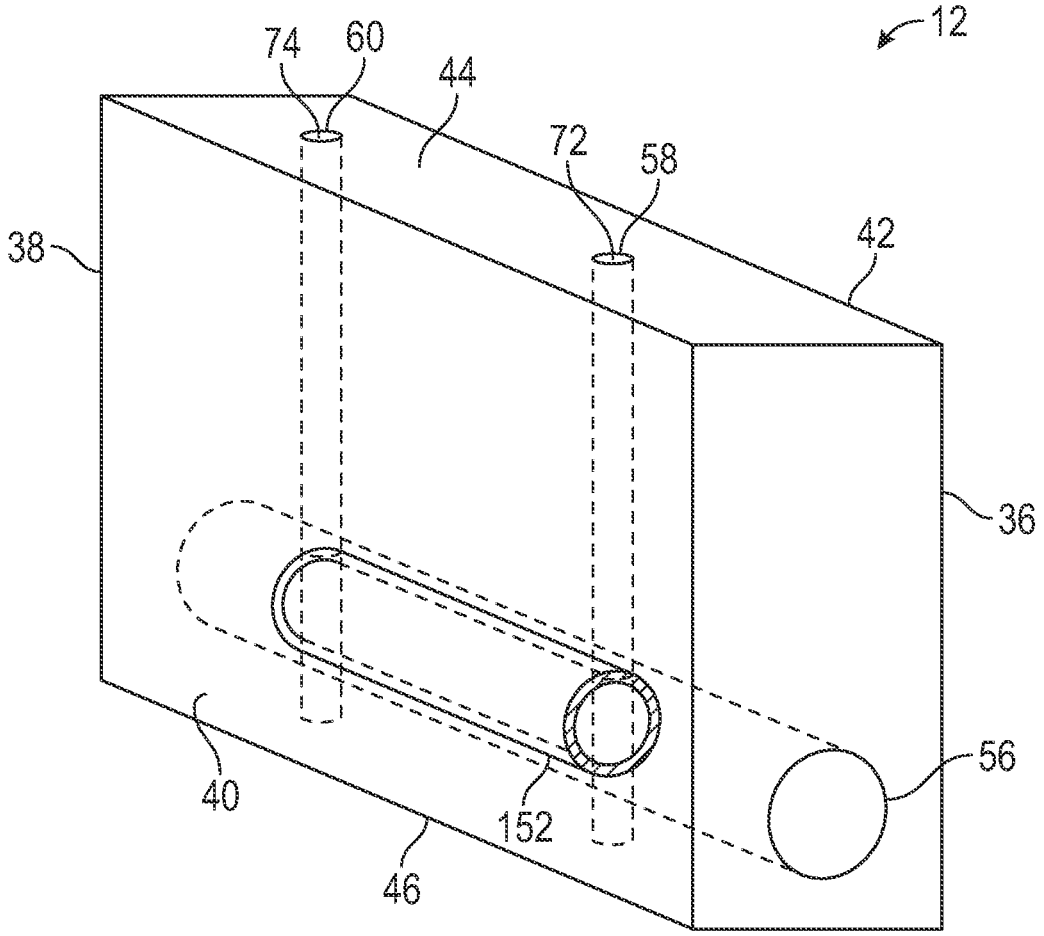
FIG. 10 is a perspective view of the fluid end body showing the pump section valve sleeve within the pump piston fluid path.

In FIG. 10, the pump fluid path sleeve 152 is positioned within the pump piston fluid path 56 between the first horizontal fluid path 52 and the second horizontal fluid path 54, and is locked into position by the front liner cage flange 26 and the back liner cage flange 28. With the pump fluid path sleeve 152 installed within the pump piston fluid path 56, the pump plunger 122 may require a smaller outer diameter to account for the thickness of the pump fluid path sleeve 152. For example, in one embodiment, the pump plunger 122 may have a diameter of approximately 4.00 inches when the pump fluid path sleeve 152 has an inside diameter of approximately 4.010 inches. The pump fluid path sleeve 152 may be removed from the pump piston fluid path 56 and quickly changed out by removing the at least one of the front liner cage flange 26 or the back liner cage flange 28 from the fluid end body 12.

The one or more vertical fluid path sleeve 154, may be positioned within the first vertical fluid path 58 and the second vertical fluid path 60 between the first horizontal fluid path 52 and the second horizontal fluid path 54, and between the second horizontal fluid path 54 and each of the front liner cage flange 26 and the back liner cage flange 28. The one or more vertical fluid path sleeve 154 may be removed from the first vertical fluid path 58 and the second vertical fluid path 60 and quickly changed out by removing at least one of the plurality of vertical flow port flanges 20.

The inlet fluid path sleeve 156 may be positioned within the inlet fluid path 62 and in fluid communication with the first fluid port 14. The inlet fluid path sleeve 156 includes a plurality of holes extending through the outer surface to the inner surface of the inlet fluid path sleeve 156, located at the intersection between the inlet fluid path 62 and each of the first horizontal fluid path 52 for each of the one or more veins 18 to maintain fluid communication between the plurality of interconnected fluid paths, and more specifically, between the plurality of sleeves.

In one embodiment, an outlet fluid path sleeve 158 may be positioned within the outlet fluid path 64 and in fluid communication with the second fluid port 16. The outlet fluid path sleeve 158 includes a plurality of holes extending through the outer surface to the inner surface of the outlet fluid path sleeve 158, located at the intersection between the outlet fluid path 64 and each of the second horizontal fluid path 54 for each of the veins 18 to maintain fluid communication between the plurality of interconnected fluid paths, and more specifically, between the plurality of sleeves.

The valve sleeve assembly is designed for multipurpose job selections using protection materials such as, high carbon steel, stainless steel, and rubber/plastic coated inner walls. The outside diameter of the valve sleeve assembly may be slightly smaller than the diameter of the plurality of interconnected fluid paths in which they are positioned to allow the valve sleeve assembly to be quickly installed or changed at the job site. For example, the pump fluid path sleeve 152 may have an outside diameter of approximately 7.990 inches whereas, the inside diameter of the pump piston fluid path 56 is approximately 8.00 inches.

Figure 11:
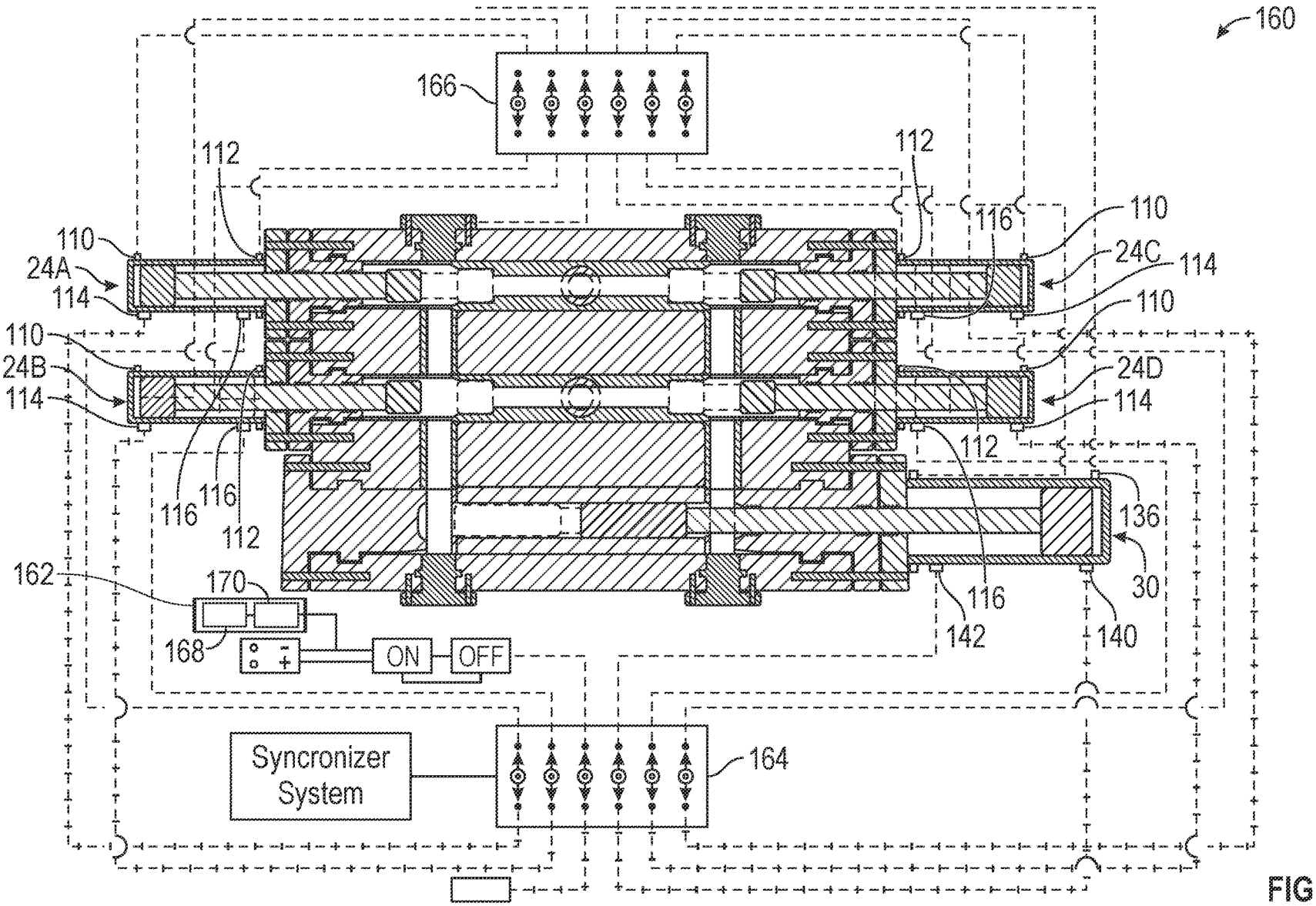
FIG. 11 is a sectional view of the fluid pump assembly including a diagrammatic drawing of a hydraulic cylinder valve control system.

Turning now to FIG. 11, the fluid pump assembly 10 further comprises a hydraulic cylinder valve control system 160 operable to synchronize the opening and closing of the plurality of hydraulic control valves 24 in conjunction with movement of fluid through the pumping of the linear pump 30*a*. The hydraulic cylinder valve control system 160 includes a computer system 162, a sensor controller 164, and a valve controller 166.

The computer system 162 may have a processor 168 and a non-transitory readable medium 170 storing computer executable instructions. The computer system 162 is configured to transmit and receive a plurality of electronical signals between the sensor controller 164 and the valve controller 166. The sensor controller 164 receives signals from the first sensor 114 and second sensor 116 of the hydraulic control cylinder 34 of each of the plurality of hydraulic control valves 24 to determine the position of the valve piston head 88 and the pump piston head 118. The sensor controller 164 receives signals from the first sensor 140 and a second sensor 142 of the linear pump hydraulic intensifier cylinder 32 of the linear pump 30. The sensor controller 164 will send the location signal to the computer system 162.

Before the push stroke, the processor 168 may receive a set of executable instructions from the non-transitory readable medium 170 that cause the processor 168 to configure the plurality of hydraulic control valves 24 to a push stroke configuration. For example, in one embodiment, the processer 168 will instruct the valve controller 166 to open the second valve assembly 24B and the third valve assembly 24C and to close the first valve assembly 24A and the fourth valve assembly 24D. The processor 168 may receive a set of executable instructions from the non-transitory readable medium 170 that cause the processor 168 to cause the linear pump 30 to perform the push stroke. The valve controller 166 may be instructed by the processor 168 to cause the linear pump 30 to move the pump plunger 122 toward the second end 38 until the pump piston head 118 reaches the second sensor 142. The second sensor 142 sends a signal to the sensor controller 164 that the pump piston head 118 is within a predetermined distance to the proximal wall 128, indicating the push stroke is complete. The sensor controller 164 instructs the valve controller 166 to stop the push stroke.

After completion of the push stroke, the processor 168 may execute computer executable instructions that cause the processor 168 to configure the plurality of hydraulic control valves 24 to a back stroke configuration. For example, in one embodiment, the computer system 162 instructs the valve controller 166 to reverse the plurality of hydraulic control valves 24, such that the first valve assembly 24A and the fourth valve assembly 24D are moved to the open position, and the second valve assembly 24B and the third valve assembly 24C are moved to the closed position. The processor 168 may execute computer executable instructions received from the non-transitory readable medium 170 that cause the processor 168 to cause the linear pump 30 to perform the back stroke. The valve controller 166 may be instructed by the processor 168 to cause the linear pump 30 to move the pump plunger 122 toward the first end 36 until the pump piston head 118 reaches the first sensor 140. The first sensor 140 sends a signal to the sensor controller 164 that the pump piston head 118 is within a predetermined distance to the distal wall 130 indicated the push, indicating the back stroke is complete. The hydraulic cylinder valve control system 160 may then begin another cycle.

The timing sequence is pre-entered into the software program and adjusts automatically if undesirable pressure discrepancies occur between plurality of hydraulic control valves 24. In one embodiment, the hydraulic cylinder valve control system 160 may require the plurality of hydraulic control valves 24 be configure in the push stroke configuration prior to performing the push stroke, and in the back stroke configuration prior to performing the back stroke. In one embodiment, the valve controller 166 may cause the plurality of hydraulic control valves 24 to transition between the open position or closed position, simultaneously with initiation of the push stroke or back stroke of the linear pump 30.

Figure 12:
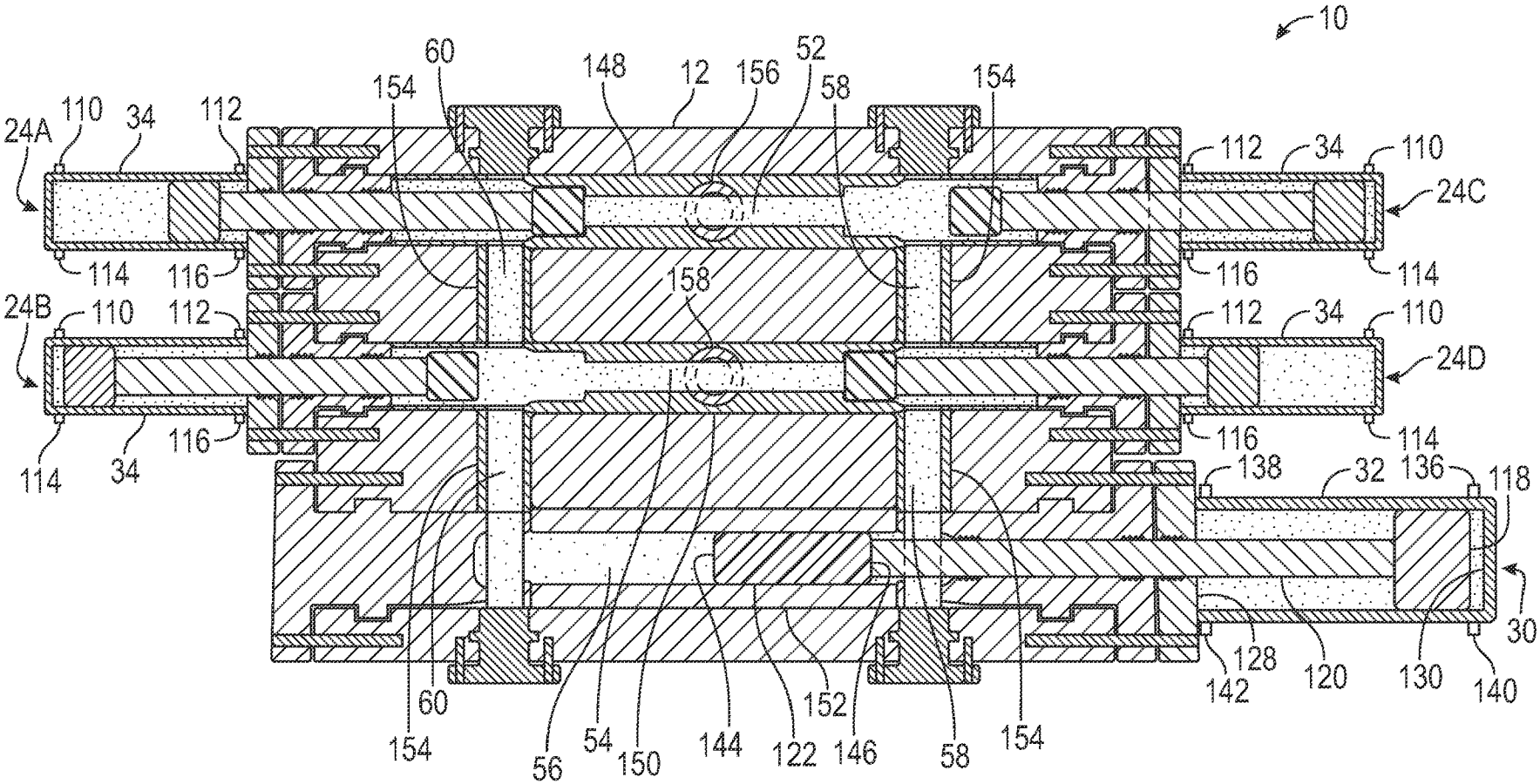
FIG. 12 is a sectional view of the fluid pump assembly in a pre-push stroke configuration.
Figure 13:
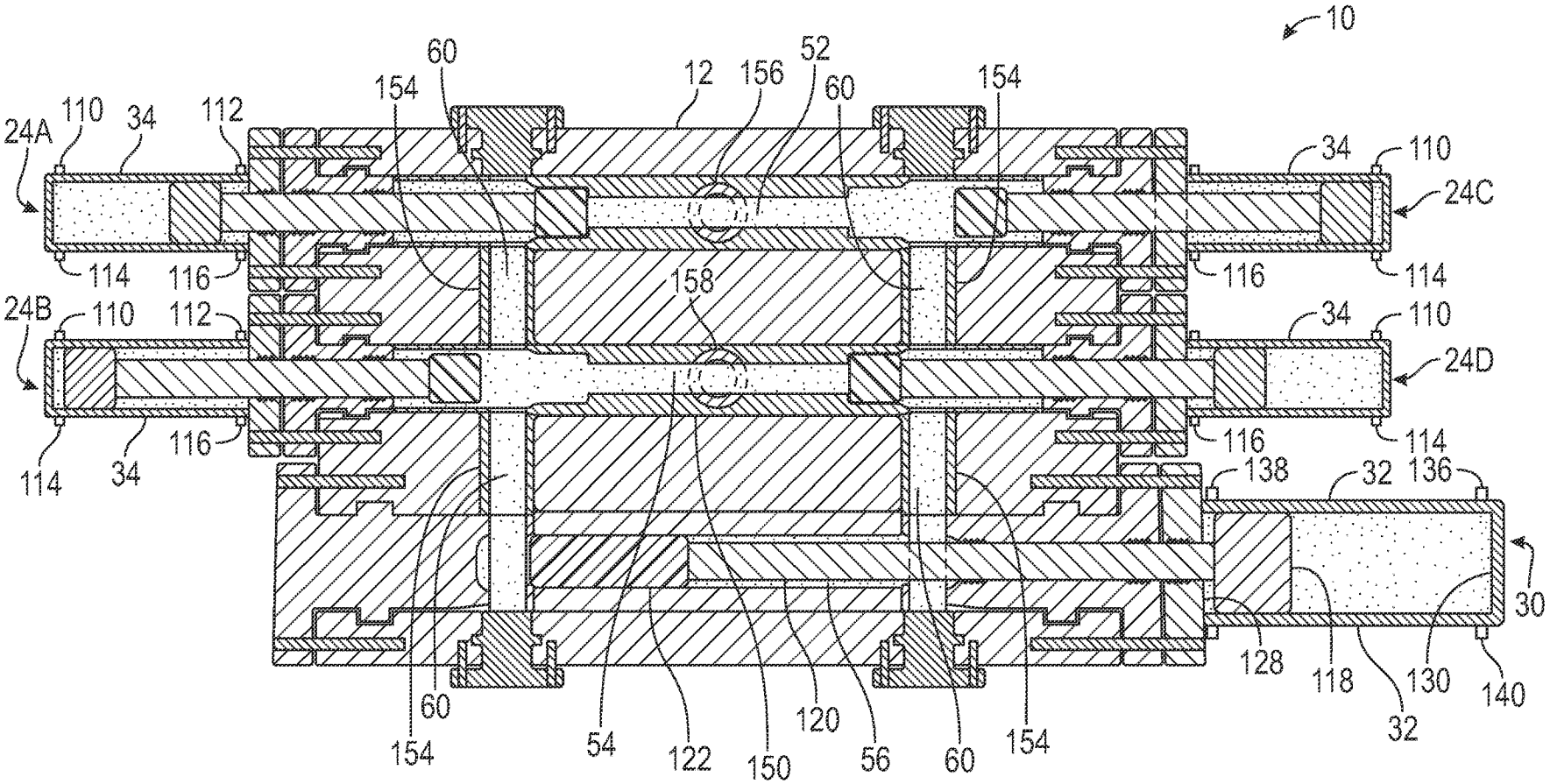
FIG. 13 is a sectional view of the fluid pump assembly in a post-push stroke configuration.

In use, as shown in FIG. 12 (pre-push stroke) and FIG. 13 (post-push stroke), the fluid pump assembly 10 is depicted before and after the push stroke. At the beginning of the push stroke, pressurized hydraulic fluid has been supplied to the first port 110 of the hydraulic control cylinder 34 of the first valve assembly 24A and the fourth valve assembly 24D to ensure the first valve assembly 24A and the fourth valve assembly 24D are in the closed position. Pressurized hydraulic fluid has been supplied to the second port 112 of the hydraulic control cylinder 34 of the second valve assembly 24B and the third valve assembly 24C to ensure the second valve assembly 24B and the third valve assembly 24C are in the open position.

Pressurized hydraulic fluid is sent to the linear pump hydraulic intensifier cylinder 32, between the distal wall 130 and the pump piston head 118 via the first port 136. The pump piston head 118 moves toward the proximal wall 128 pushing the pump plunger 122 toward the second end 38 of the fluid end body 12 via the pump shaft 120. The pump plunger 122 pushes frack fluid into the one or more vertical fluid path sleeves 154 within the second vertical fluid path 60, and past the second valve assembly 24B. Due to the first valve assembly 24A being in the closed position, pressurized frack fluid moves through the second horizontal fluid path sleeve 150, through the outlet fluid path sleeve 158, and out the second fluid port 16 to the well.

As the linear pump hydraulic intensifier cylinder 32 begins the push stroke, low pressure/high volume frack fluid is pumped into the first fluid port 14, through the inlet fluid path sleeve 156, and through the first horizontal fluid path 52. The third valve assembly 24C is held in the open position, allowing the fluid to move through the one or more vertical fluid path sleeve 154 of the first vertical fluid path 58, past the closed fourth valve assembly 24D, and into the pump fluid path sleeve 152 therefore filling the void behind the pump plunger 122 as it evacuates pressurized fluid from the area on the front side 144 of the pump plunger 122.

At the end of the push stroke, the pump piston head 118 reaches the proximal wall 128. The second sensor 142 send a position signal to the sensor controller 164 which in turn commands the valve controller 166 to reverse the direction of the pressurized hydraulic fluid. Pressurized hydraulic fluid is sent to the first port 110 of the hydraulic control cylinder 34 of the second valve assembly 24B and the third valve assembly 24C, and to the second port 112 of the hydraulic control cylinder 34 of the first valve assembly 24A and the fourth valve assembly 24D. Simultaneously, pressurized hydraulic fluid is sent to the second port 138 of the linear pump hydraulic intensifier cylinder 32 to drive the pump piston head 118 away from the proximal wall 128.

Figure 14:
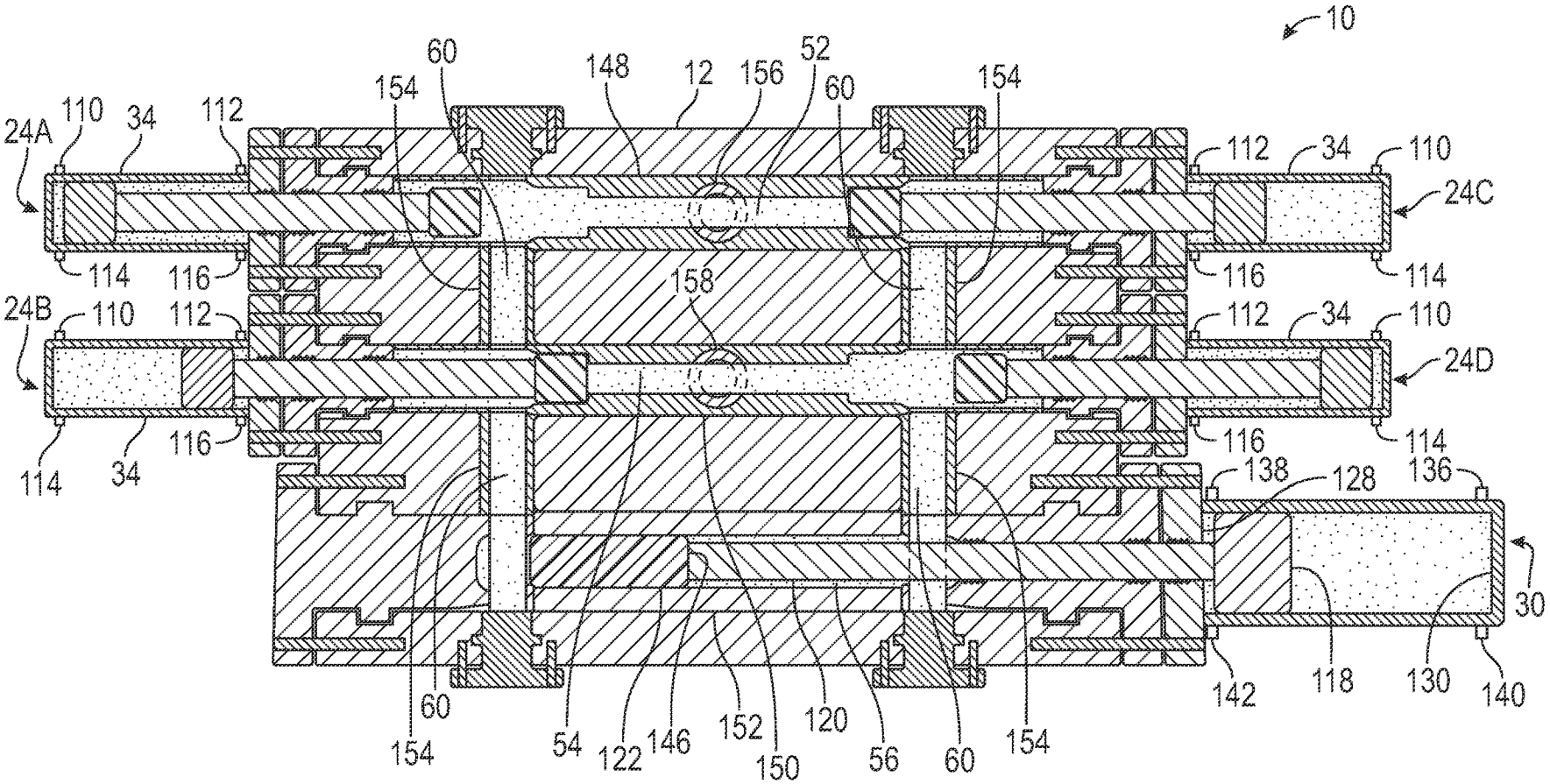
FIG. 14 is a sectional view of the fluid pump assembly in a pre-back stroke configuration.
Figure 15:
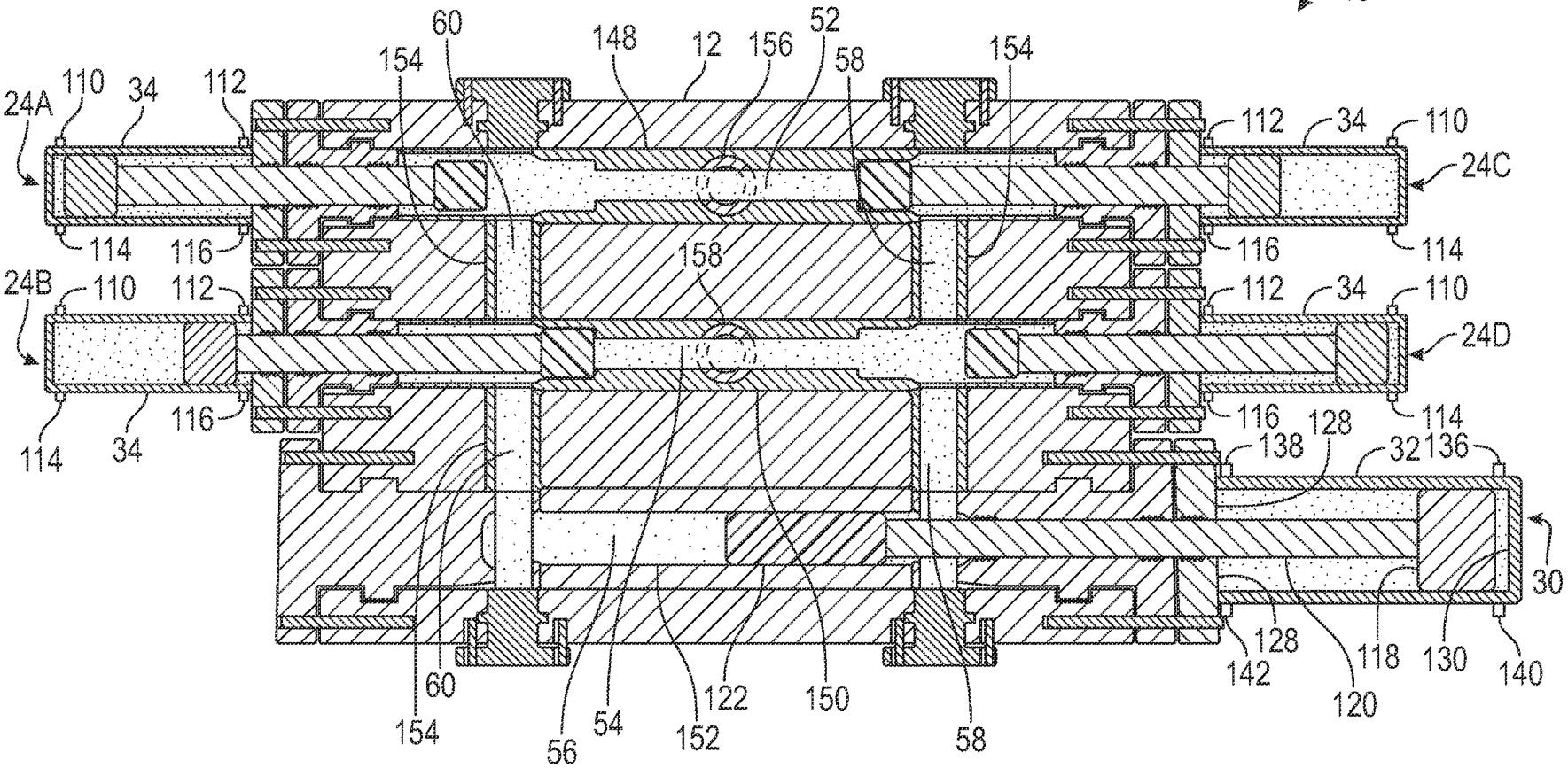
FIG. 15 is a sectional view of the fluid pump assembly in a post-back stroke configuration.

In FIG. 14 (pre-back stroke) and FIG. 15 (post-back stroke), the fluid pump assembly 10 is depicted before and after the back stroke. At the beginning of the back stroke, the first valve assembly 24A and the fourth valve assembly 24D are in the open position and the second valve assembly 24B and the third valve assembly 24C are in the closed position.

The first valve assembly 24A and second valve assembly 24B are now in position for the low pressure/high volume frack fluid to continue frack fluid delivery through the first fluid port 14, through the inlet fluid path sleeve 156, and through the first horizontal fluid path 52. The frack fluid moves to the one or more vertical fluid path sleeves 154 of the second vertical fluid path 60, past the first valve assembly 24A that is open, past the second valve assembly 24B that is closed, and into the pump fluid path sleeve 152 to fill the void as the pump plunger 122 moves toward the first end 36. The frack fluid being pushed by the back side 146 moving toward the first end 36 is of a lower volume due to the surface area reduction of the pump plunger 122 and the connection to the pump shaft 120. The pressurized frack fluid moves into the one or more vertical fluid path sleeves 154 of the first vertical fluid path 58 and past the fourth valve assembly 24D that is open. Since the third valve assembly 24C is closed, the pressurized fluid travels into the second horizontal fluid path sleeve 150, through the outlet fluid path sleeve 158, and out the second fluid port 16 and on to the well. This has completed one full stroke of the fluid pump assembly 10.

Figure 16:
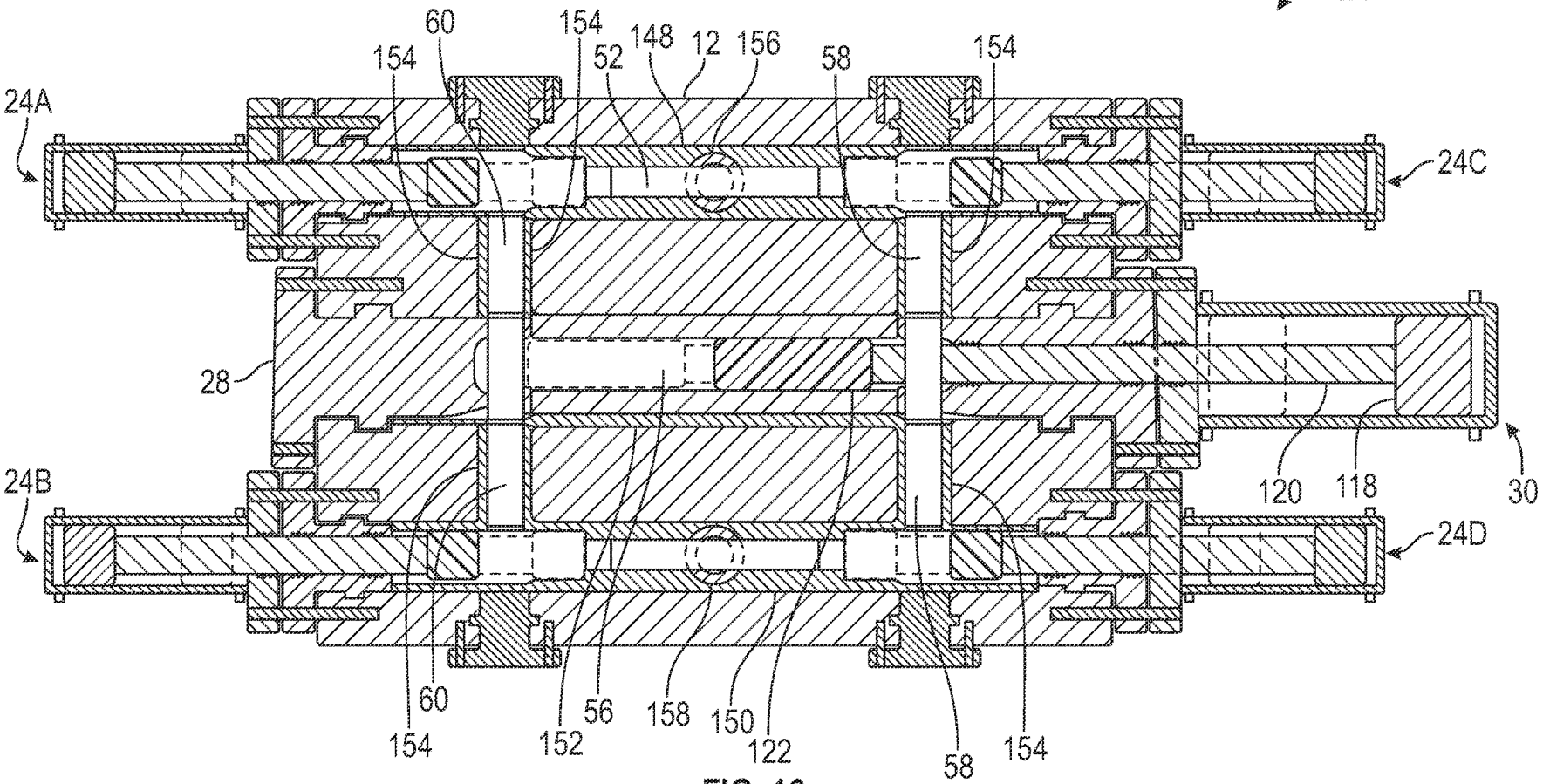
FIG. 16 is a sectional view of an alternate embodiment of a fluid pump assembly constructed in accordance with the inventive concepts disclosed herein.

Another embodiment of the of a fluid pump assembly 10A is shown in FIG. 16 constructed in accordance with the inventive concepts disclosed herein. The fluid pump assembly 10*a* is substantially similar in fluid pump assembly 10 with the primary difference being the configuration of the linear pump 30 relative to the plurality of hydraulic control valves 24. In the fluid pump assembly 10A, the first horizontal fluid path 52 is positioned proximate to the top side 44, the second horizontal fluid path 54 is positioned proximate to the bottom side 46, and the pump piston fluid path 56 is interposed between the first horizontal fluid path 52 and the second horizontal fluid path 54. In all other respects, the fluid pump assembly 10A operates in substantially the same manner as the fluid pump assembly 10.

From the above description, it is clear that the inventive concepts disclosed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed.

What is claimed is:

1. A fluid pump assembly, comprising:

a one-piece block having a first end, a second end, a first side, a second side, a top side, and a bottom side, the one-piece block having a first vertical fluid path and a second vertical fluid path extending between the top side and the bottom side and being spaced between the first end and second end, a first horizontal fluid path, a second horizontal fluid path, and a pump piston fluid path extending between the first end and the second end and being spaced between the top side and the bottom side, the first horizontal fluid path, the second horizontal fluid path, and the pump piston fluid path being in fluid communication with the first vertical fluid path and the second vertical fluid path, a fluid inlet port in fluid communication with the first horizontal fluid path interposed between the first vertical fluid path and the second vertical fluid path and operable to receive a fluid into the one-piece block, and a fluid outlet port in fluid communication with the second horizontal fluid path interposed between the first vertical fluid path and the second vertical fluid path and operable to discharge the fluid from the second horizontal fluid path externally from the one-piece block;

a pump unit having a hydraulic cylinder, a piston, and a plunger, the plunger having a front side and a back side with the back side attached to the piston driven by the hydraulic cylinder in a reciprocating linear action such that the plunger moves within the pump piston fluid path, wherein the plunger moves the fluid within the pump piston fluid path on the front side of the plunger on a push stroke of the hydraulic cylinder, and moves the fluid within the pump piston fluid path on the back side of the plunger on a back stroke of the hydraulic cylinder;

a hydraulic cylinder valve control system having a valve controller, a first valve, a second valve, a third valve, and a fourth valve, wherein the first valve is operable to allow fluid to flow from the fluid inlet port to the second vertical fluid path in an open position, and restrict fluid to flow between the fluid inlet port and the second vertical fluid path in a closed position, the second valve is operable to allow fluid to flow from the second horizontal fluid path to the outlet fluid port in an open position, and restrict the flow of fluid between the second vertical fluid path and the outlet fluid port in a closed position, the third valve is operable to allow fluid to flow from the fluid inlet port to the first vertical fluid path in an open position, and restrict the flow of fluid between the fluid inlet port and the first vertical fluid path in a closed position, the fourth valve is operable to allow fluid to flow from the first vertical fluid path to the outlet fluid port in an open position, and restrict the flow of fluid between the outlet fluid port and the first vertical fluid path in a closed position, wherein the valve controller is operable to cause the second valve and third valve to be in the open position and the first valve and fourth valve to be in the closed position during the push stroke, and to cause the first valve and the fourth valve to be in the open position and the second valve and the third valve to be in the closed position during the back stroke; and a valve sleeve assembly including a first horizontal valve seat sleeve, a second horizontal valve seat sleeve, a pump section valve sleeve, and one or more vertical valve sleeves, wherein the first horizontal valve seat sleeve is within the first horizontal fluid path, the second horizontal valve seat sleeve is positioned within the second horizontal fluid path, and the pump section valve sleeve is positioned within the pump piston fluid path, wherein the one or more vertical valve sleeves are positioned between each of the first horizontal valve seat sleeve, the second horizontal valve seat sleeve, and the pump section valve sleeve such that the valve sleeve assembly reduces fluid contact with the one-piece block as the fluid is directed through the valve sleeve assembly.

2. A fluid pump assembly, comprising:

a one-piece block having a first end, a second end, a first side, a second side, a top side, and a bottom side, the one-piece block having an inlet fluid port, an outlet fluid port, an inlet fluid path, an outlet fluid path, a first connecting fluid path, a second connecting fluid path, and a pump piston fluid path, the inlet fluid port in fluid communication with the inlet fluid path and the outlet fluid port in fluid communication with the outlet fluid path, the first connecting fluid path intersecting the inlet fluid path, the outlet fluid path, and the pump piston fluid path, the second connecting fluid path intersecting the inlet fluid path, the outlet fluid path, and the pump piston fluid path;

a first control valve connected to the one-piece block and having a valve head movable between an open position wherein fluid flow is permitted between the inlet fluid path and the first connecting fluid path and a closed position wherein the fluid flow is sealed between the inlet fluid path and the first connecting fluid path;

a second control valve connected to the one-piece block and having a valve head movable between an open position wherein fluid flow is permitted between the outlet fluid path and the first connecting fluid path and a closed position wherein the fluid flow is sealed between the outlet fluid path and the first connecting fluid path;

a third control valve connected to the one-piece block and having a valve head movable between an open position wherein fluid flow is permitted between the inlet fluid path and the second connecting fluid path and a closed position wherein the fluid flow is sealed between the inlet fluid path and the first connecting fluid path;

a fourth control valve connected to the one-piece block and having a valve head movable between an open position wherein fluid flow is permitted between the outlet fluid path and the second connecting fluid path and a closed position wherein the fluid flow is sealed between the outlet fluid path and the second connecting fluid path;

a linear pump connected to the one-piece block and having a pump plunger positioned in the pump piston fluid path to reciprocate between the first connecting fluid path and the second connecting fluid path in a push stroke and a back stroke; and a valve control system operably connected to the first control valve, the second control valve, the third control valve, the fourth control valve, and the linear pump to cause the pump plunger of the linear pump to reciprocate between the push stroke and the back stroke and to cause the valve head of the first control valve and the valve head of the fourth control valve to move to the open position and to cause the valve head of the second control valve and the valve head of the third control valve to move to the closed position when the pump plunger of the linear pump is in the push stroke, and to cause the valve head of the first control valve and the valve head of the fourth control valve to move to the closed position and to cause the valve head of the second control valve and the valve head of the third control valve to move to the open position when the pump plunger of the linear pump is in the back stroke.

3. The fluid pump assembly of claim 2, wherein the one-piece block is a cuboid.

4. The fluid pump assembly of claim 2, wherein each of the inlet fluid path, the outlet fluid path, the first connecting fluid path, the second connecting fluid path, and the pump piston fluid path is lined with a sleeve.

5. The fluid pump assembly of claim 2, wherein each of the valve heads is formed of a rubber material.

6. The fluid pump assembly of claim 5, wherein each of the valve heads has a cylindrical shape.

7. The fluid pump assembly of claim 2, wherein the pump plunger is formed of a rubber material.

8. The fluid pump assembly of claim 7, wherein the pump plunger has a cylindrical shape.

* * * * *